US011289006B2

(12) United States Patent
Qiu et al.

(10) Patent No.: US 11,289,006 B2
(45) **Date of Patent: *Mar. 29, 2022**

(54) SYSTEMS AND METHODS OF REDUCING DISPLAY POWER CONSUMPTION WITH MINIMAL EFFECT ON IMAGE QUALITY

(71) Applicant: Intel Corporation, Santa Clara, CA (US)

(72) Inventors: Junhai Qiu, Portland, OR (US); Ajit Joshi, Portland, OR (US); Jun Jiang, Portland, OR (US); Sherine Abdelhak, Beaverton, OR (US); Shravan Kumar Belagal Math, Bangalore (IN); Nandini Mahendran, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/188,807

(22) Filed: Mar. 1, 2021

(65) Prior Publication Data

US 2021/0183300 A1 Jun. 17, 2021

Related U.S. Application Data

(63) Continuation of application No. 16/456,125, filed on Jun. 28, 2019, now Pat. No. 10,937,358.

(51) Int. Cl.
*G09G 3/20* (2006.01)

(52) U.S. Cl.
CPC ..... *G09G 3/2096* (2013.01); *G09G 3/2003* (2013.01); *G09G 2320/0666* (2013.01); *G09G 2330/023* (2013.01)

(58) Field of Classification Search
CPC ..... G09G 3/2096; G09G 3/2003; G09G 2320/0666; G09G 2330/023; G09G 2320/0271; G09G 2330/021; G09G 3/3406
See application file for complete search history.

(56) References Cited

U.S. PATENT DOCUMENTS 7,924,261 B2 * 4/2011 Kerofsky ..... G09G 3/3413 345/102
8,194,028 B2 * 6/2012 Fletcher ..... G09G 3/3406 345/102

(Continued)

OTHER PUBLICATIONS

United States Patent and Trademark Office, "Notice of Allowance," dated Oct. 15, 2020 in connection with U.S. Appl. No. 16/456,125, 12 pages.

(Continued)

*Primary Examiner* — Amy Onyekaba
(74) *Attorney, Agent, or Firm* — Hanley, Flight & Zimmerman, LLC

(57) ABSTRACT

Example display power management control circuitry is to determine a baseline image quality parameter associated with a baseline display power mode based on: a baseline first relationship parameter associated with a first relationship between original and boosted pixel values; a baseline percentage of pixels having a color value; and a baseline second relationship parameter associated with a second relationship between the numbers of original pixel values and boosted pixel values; determine a value of a subsequent first relationship parameter based on an adjusted second relationship parameter and a second percentage of pixels having the color value; determine a second image quality parameter associated with the subsequent first relationship parameter, the adjusted second relationship parameter, and the second percentage of pixels; and select the subsequent first rela- (Continued)

tionship parameter and the adjusted second relationship parameter based on comparing the second image quality parameter to the baseline image quality parameter.

24 Claims, 5 Drawing Sheets

(56) References Cited

U.S. PATENT DOCUMENTS 8,704,844 B2* 4/2014 Fleck ..... G09G 3/3413 345/589
8,766,902 B2* 7/2014 Barnhoefer ..... G09G 3/3406 345/102
10,937,358 B2 3/2021 Qiu et al.
10,971,085 B2 4/2021 Qiu et al.
2004/0113906 A1* 6/2004 Lew ..... G09G 3/3406 345/211
2004/0257318 A1* 12/2004 Itoh ..... G09G 3/3406 345/87
2005/0104838 A1* 5/2005 Sasaki ..... G09G 3/3406 345/102
2006/0119612 A1 6/2006 Kerofsky et al.
2006/0119613 A1 6/2006 Kerofsky
2006/0262111 A1 11/2006 Kerofsky
2006/0274026 A1 12/2006 Kerofsky
2006/0284822 A1* 12/2006 Kerofsky ..... G09G 3/3406 345/102
2007/0146236 A1 6/2007 Kerofsky et al.
2007/0291048 A1 12/2007 Kerofsky
2008/0079756 A1* 4/2008 Akai ..... G09G 3/3406 345/690
2008/0272999 A1 11/2008 Kurokawa et al.
2008/0297467 A1* 12/2008 Hsu ..... G09G 3/3406 345/102
2009/0021455 A1* 1/2009 Miller ..... G09G 3/3216 345/77
2009/0066715 A1 3/2009 Chen
2009/0109170 A1* 4/2009 Kwon ..... G09G 3/3406 345/102
2009/0109232 A1 4/2009 Kerofsky
2009/0140970 A1* 6/2009 Kerofsky ..... G09G 3/3426 345/102
2009/0141178 A1* 6/2009 Kerofsky ..... H04N 21/44008 348/700
2009/0167671 A1* 7/2009 Kerofsky ..... G09G 3/3413 345/102
2009/0167672 A1* 7/2009 Kerofsky ..... G09G 3/3413 345/102
2009/0167673 A1* 7/2009 Kerofsky ..... G09G 3/3413 345/102
2009/0167751 A1* 7/2009 Kerofsky ..... G09G 3/3611 345/214
2009/0219244 A1* 9/2009 Fletcher ..... G09G 3/3406 345/102
2009/0232411 A1* 9/2009 Chen ..... G09G 3/2007 382/274
2009/0267876 A1* 10/2009 Kerofsky ..... G09G 3/2007 345/87
2009/0284461 A1 11/2009 Hsu et al.
2010/0007599 A1* 1/2010 Kerofsky ..... G09G 3/3611 345/102
2010/0013750 A1 1/2010 Kerofsky et al.
2010/0053222 A1* 3/2010 Kerofsky ..... G09G 3/3406 345/690
2011/0115766 A1* 5/2011 Kerofsky ..... H04N 21/42202 345/207
2011/0141244 A1 6/2011 Vos et al.
2011/0242139 A1 10/2011 Toshima et al.
2011/0298843 A1* 12/2011 Hajjar ..... G09G 3/2003 345/690
2012/0007880 A1 1/2012 Huang et al.
2012/0056907 A1 3/2012 Lee et al.
2012/0075353 A1* 3/2012 Dong ..... G09G 3/3406 345/690
2012/0218313 A1 8/2012 Chiou et al.
2013/0050296 A1* 2/2013 Plut ..... G09G 3/3406 345/690
2014/0267325 A1* 9/2014 Jiang ..... G06F 11/3051 345/520
2017/0110069 A1* 4/2017 Shoshan ..... G09G 3/3413
2019/0147806 A1* 5/2019 Qiu ..... G09G 3/3406 345/212
2020/0074944 A1* 3/2020 Kang ..... G09G 3/3607
2020/0126471 A1 4/2020 Qiu et al.
2021/0183322 A1 6/2021 Qiu et al.

OTHER PUBLICATIONS

United States Patent and Trademark Office, "Notice of Allowance," dated Jan. 29, 2021 in connection with U.S. Appl. No. 16/456,125, 2 pages.
United States Patent and Trademark Office, "Non-Final Office Action," dated Apr. 14, 2020 in connection with U.S. Appl. No. 16/242,603, 10 pages.
United States Patent and Trademark Office, "Notice of Allowance," dated Aug. 3, 2020 in connection with U.S. Appl. No. 16/242,603, 6 pages.
United States Patent and Trademark Office, "Non-Final Office Action," dated Aug. 11, 2021 in connection with U.S. Appl. No. 17/186,377, 10 pages.
United States Patent and Trademark Office, "Notice of Allowance," dated Nov. 18, 2020 in connection with U.S. Appl. No. 16/242,603, 6 pages.
United States Patent and Trademark Office, "Notice of Allowance," dated Feb. 2, 2022 in connection with U.S. Appl. No. 17/186,377, 8 pages.

* cited by examiner

SYSTEMS AND METHODS OF REDUCING DISPLAY POWER CONSUMPTION WITH MINIMAL EFFECT ON IMAGE QUALITY

RELATED APPLICATION

This patent arises from a continuation of U.S. patent application Ser. No. 16/456,125, filed Jun. 28, 2019, and entitled "SYSTEMS AND METHODS OF REDUCING DISPLAY POWER CONSUMPTION WITH MINIMAL EFFECT ON IMAGE QUALITY," which is incorporated herein by reference in its entirety. Priority to U.S. patent application Ser. No. 16/456,125 is claimed.

TECHNICAL FIELD

The present disclosure relates to display devices, specifically display devices having power saving features.

BACKGROUND

Modern display devices, particularly liquid crystal display (LCD) devices and light emitting diode (LED) devices rely upon a back-light supplying fairly intense back-illumination to a color panel to produce visible output. The power consumed by such back-lights is considerable, particularly for handheld and portable devices such as smartphones, tablet computers, laptop computers, wearable computers, and similar portable processor-based devices. A class of power saving technologies includes selectively limiting the power consumption of display backlights. Such power saving technologies, while somewhat effective typically compromise the quality of the display image. Each reduction in luminous output causes distortion of a percentage of picture elements (pixels) comprising the display image.

BRIEF DESCRIPTION OF THE DRAWINGS

Features and advantages of various embodiments of the claimed subject matter will become apparent as the following Detailed Description proceeds, and upon reference to the Drawings, wherein like numerals designate like parts, and in which:

DETAILED DESCRIPTION

Figure 1:
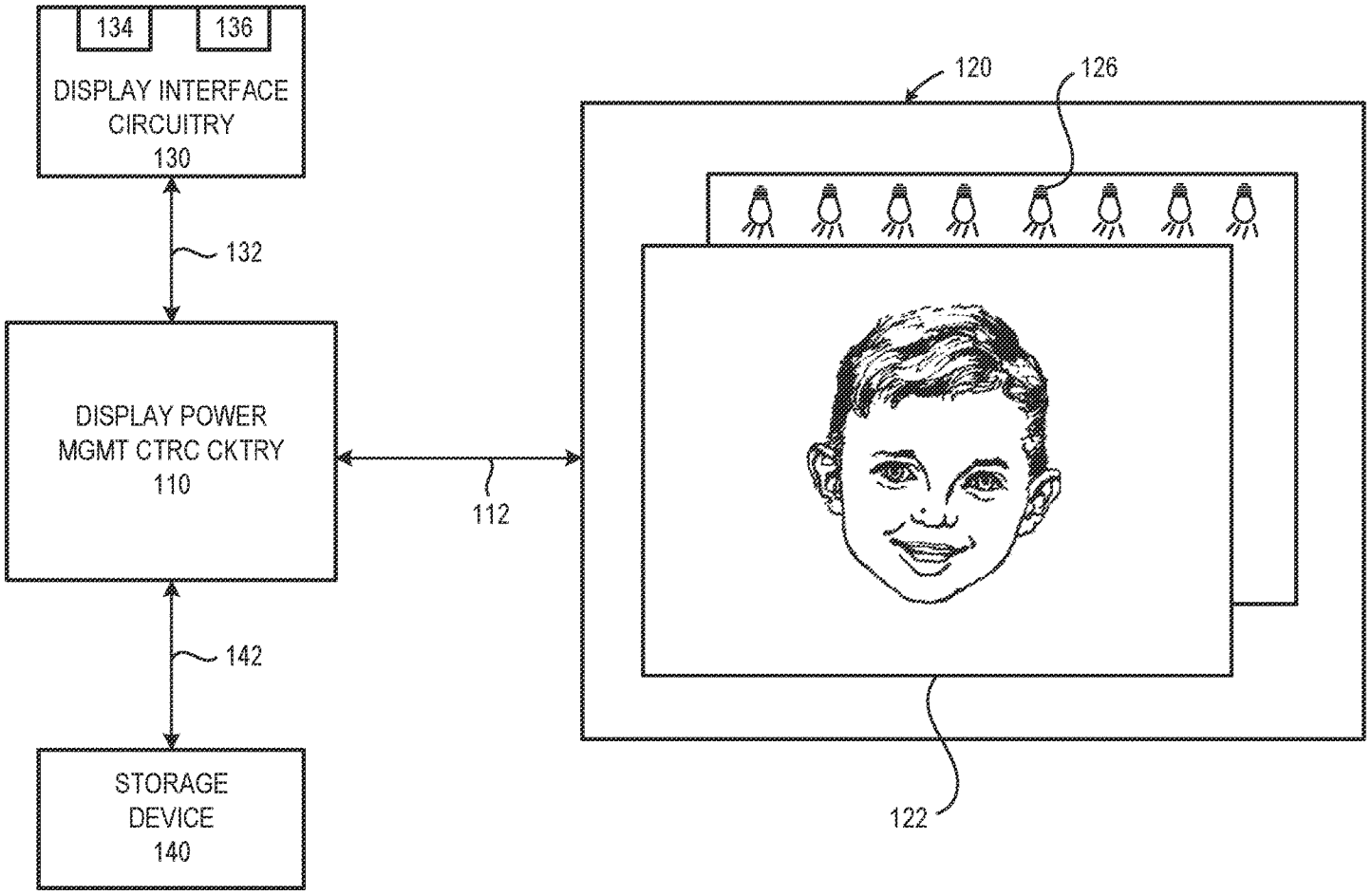
FIG. 1 depicts a block diagram of an illustrative system that includes display power management control circuitry coupled to a display device capable of operating at a plurality of power settings and in which the display control circuitry optimizes the image quality produced by the display device at each of the plurality of power settings, in accordance with at least one embodiment described herein.

Display Power Saving Technology (DPST) adaptively reduces backlight power consumption while maintaining satisfactory perceptive quality. DPST includes five power saving levels, each of which balances image quality against power savings. Each power saving level determines a percentage of pixels in the display that will have brightness reduced or distorted and the degree of distortion. When viewed as a graphical plot of Original Pixel Values (x-coordinate) against Boosted Pixel Values (y-coordinate) the percentage of pixels being distorted defines an inflection point above which pixels are under-boosted and below which pixels are over-boosted. The inflection point (which may vary from image to image) and the upper slope determine the degree of power savings. However, at times, even under the highest level of illumination, a significant loss of brightness occurs in some images. Thus, the use of a fixed power saving envelope fails to provide the best possible image quality.

The systems and methods disclosed herein beneficially and advantageously optimize power consumption at each of a plurality of display device power levels while maintaining image quality. Rather than optimize image quality at a fixed power level, the systems and methods disclosed herein instead optimize power consumption while attempting to maintain a relatively fixed image quality. The pixels forming a display image are initially quantized based on the original 8-bit color value, forming a color distribution histogram that includes data representative of original pixel color values plotted against data representative of the boosted pixel color value. The selected display power mode provides a first relationship between the original pixel value distribution and the boosted pixel value distribution (e.g., an upper line segment having a slope ($K_{1,BASELINE}$) For any given display image provided by the display device, a baseline percentage of white pixels ($X_{i,BASELINE}$) may be determined. Using the baseline first relationship ($K_{1,BASELINE}$) and the baseline percentage of "white" pixels ($X_{i,BASELINE}$) a baseline second relationship ($K_{0,BASELINE}$) may be determined. The resultant set of values ($K_{0,BASELINE}$, $K_{1,BASELINE}$, $X_{i,BASELINE}$) provide a quantifiable characterization of both power consumption and image quality for the display image provided by a display device.

The systems and methods described herein determine a maximum value for the second relationship ($K_{0,MAX}$). The systems and methods described herein then decrement the second relationship through a plurality of values ($K_{0,n}$) from ($K_{0,MAX}$) to ($K_{0,BASELINE}$). At each value "n" for c the systems and methods described herein determine a maximum value ($K_{1,MAX}$) for the first relationship. The pixel percentage ($X_{i,n,m}$) is stepwise increased through a plurality of "n" values and a respective, corresponding, first relationship value ($K_{1,n,m}$) determined. The systems and methods described herein then determine one or more image quality parameters using the set of values ($K_{0,n}$, $K_{1,n,m}$, $X_{i,n,m}$) the determined image quality parameters at each set of values are compared to the baseline image quality parameters determined using the set of values ($K_{0,BASELINE}$, $K_{1,BASELINE}$, $X_{i,BASELINE}$). The systems and methods disclosed herein the select the set of values ($K_{0,n}$, $K_{1,n,m}$, $X_{i,n,m}$) providing the closest image quality to the image quality of the baseline parameters to provide display power settings for the display device providing the display image. Since the first relationship ($K_1$) characterizes the power consumption of the display device, and since the first relationship ($K_1$) varies between 0 and the baseline value provided by the display power setting ($K_{1,MAX}$), any set of values ($K_{0,n}$, $K_{1,n,m}$, $X_{i,n,m}$) will necessarily provide display power settings demonstrating a reduction in power consumption.

A display power reduction system is provided. The system may include: display interface circuitry to receive data representative of one or more parameters from each of one or more pixels forming a display image on a display device; display power management control circuitry coupled to the display interface circuitry, the display power management control circuitry to: determine one or more image quality (IQ) parameters for a baseline display power mode ($IQ_{BASELINE}$) using: a baseline first parameter ($K_{1,BASELINE}$) associated with a baseline first relationship between a baseline number of original pixel values and a baseline number of boosted pixel values used to form the display image; a baseline percentage of the plurality of pixels ($X_{i,BASELINE}$) having a defined color value; a baseline second parameter ($K_{0,BASELINE}$) associated with a baseline second relationship between the baseline number of original pixel values and a baseline number of boosted pixel values; adjust the second parameter to each of a plurality of second parameter values ($K_{0,1-n}$) and, for each of the plurality of second parameter values ($K_{0,n}$): adjust the percentage of pixels having the defined color value to a plurality of pixel percentages ($X_{i,1-m}$); determine the value of the first parameter at each of the plurality of pixel percentages using the second parameter value ($K_{0,n}$) and the respective pixel percentage value ($X_{i,m}$); and determine the one or more image quality parameters ($IQ_{n,m}$); and select a first parameter, second parameter pair ($K_{0,n}$, $K_{1,m}$) associated with the one or more IQ parameters ($IQ_{m,n}$) closest to the one or more baseline IQ parameters ($IQ_{BASELINE}$).

A display power reduction method is provided. The method may include: determining, by the display power management control circuitry, one or more image quality (IQ) parameters for a baseline display power mode ($IQ_{BASELINE}$) using: a baseline first parameter ($K_{1,BASELINE}$) associated with a baseline first relationship between a baseline number of original pixel values and a baseline number of boosted pixel values used to form the display image; a baseline percentage of the plurality of pixels ($X_{i,BASELINE}$) having a defined color value; a baseline second parameter ($K_{0,BASELINE}$) associated with a baseline second relationship between the baseline number of original pixel values and a baseline number of boosted pixel values; adjusting, by the display power management control circuitry, the second parameter to each of a plurality of second parameter values ($K_{0,1-n}$) and, for each of the plurality of second parameter values ($K_{0,n}$): adjusting, by the display power management control circuitry, the percentage of pixels having the defined color value to a plurality of pixel percentages ($X_{i,1-m}$); determining, by the display power management control circuitry, the value of the first parameter at each of the plurality of pixel percentages using the second parameter value ($K_{0,n}$) and the respective pixel percentage value ($X_{i,m}$); and determining, by the display power management control circuitry, the one or more image quality parameters ($IQ_{n,m}$); and selecting, by the display power management control circuitry, a first parameter, second parameter pair ($K_{0,n}$, $K_{1,m}$) associated with the one or more IQ parameters ($IQ_{m,n}$) closest to the one or more baseline IQ parameters ($IQ_{BASELINE}$).

A non-transitory storage device is provided. The non-transitory storage device may include instructions that, when executed by display power management control circuitry, causes the display power management control circuitry to: determine one or more image quality (IQ) parameters for a baseline display power mode ($IQ_{BASELINE}$) using: a baseline first parameter ($K_{1,BASELINE}$) associated with a baseline first relationship between a baseline number of original pixel values and a baseline number of boosted pixel values used to form the display image; a baseline percentage of the plurality of pixels ($X_{i,BASELINE}$) having a defined color value; a baseline second parameter ($K_{0,BASELINE}$) associated with a baseline second relationship between the baseline number of original pixel values and a baseline number of boosted pixel values; adjust the second parameter to each of a plurality of second parameter values ($K_{0,1-n}$) and, for each of the plurality of second parameter values ($K_{0,n}$): adjust the percentage of pixels having the defined color value to a plurality of pixel percentages ($X_{i,1-m}$); determine the value of the first parameter at each of the plurality of pixel percentages using the second parameter value ($K_{0,n}$) and the respective pixel percentage value ($X_{i,m}$); and determine the one or more image quality parameters ($IQ_{n,m}$); and select a first parameter, second parameter pair ($K_{0,n}$, $K_{1,m}$) associated with the one or more IQ parameters ($IQ_{m,n}$) closest to the one or more baseline IQ parameters ($IQ_{BASELINE}$).

A display power reduction system is provided. The system may include: means for determining one or more image quality (IQ) parameters for a baseline display power mode ($IQ_{BASELINE}$) using: a baseline first parameter ($K_{1,BASELINE}$) associated with a baseline first relationship between a baseline number of original pixel values and a baseline number of boosted pixel values used to form the display image; a baseline percentage of the plurality of pixels ($X_{i,BASELINE}$) having a defined color value; a baseline second parameter ($K_{0,BASELINE}$) associated with a baseline second relationship between the baseline number of original pixel values and a baseline number of boosted pixel values; means for adjusting the second parameter to each of a plurality of second parameter values ($K_{0,1-n}$) and, for each of the plurality of second parameter values ($K_{0,n}$): means for adjusting the percentage of pixels having the defined color value to a plurality of pixel percentages ($X_{i,1-m}$); means for determining the value of the first parameter at each of the plurality of pixel percentages using the second parameter value ($K_{0,n}$) and the respective pixel percentage value ($X_{i,m}$); and means for determining the one or more image quality parameters ($IQ_{n,m}$); and means for selecting a first parameter, second parameter pair ($K_{0,n}$, $K_{1,m}$) associated with the one or more IQ parameters ($IQ_{m,n}$) closest to the one or more baseline IQ parameters ($IQ_{BASELINE}$).

As used herein, the term "on-chip" or elements, components, systems, circuitry, or devices referred to as "on-chip" include such items integrally fabricated with the processor circuitry (e.g., a central processing unit, or CPU, in which the "on-chip" components are included, integrally formed, and/or provided by CPU circuitry) or included as separate components formed as a portion of a multi-chip module (MCM) or system-on-chip (SoC).

As used herein the terms "about" or "approximately" when used to prefix an enumerated value should be interpreted to indicate a value that is plus or minus 15% of the enumerated value. Thus, a value that is listed as "about 100" or "approximately 100%" should be understood to represent a value that could include any value or group of values between 85 (i.e., −15%) to 115 (i.e., +15%).

FIG. 1 depicts a block diagram of an illustrative system 100 that includes display power management control circuitry 110 coupled to a display device 120 capable of operating at a plurality of power settings and in which the display control circuitry 110 optimizes the image quality produced by the display device 120 at each of the plurality of power settings, in accordance with at least one embodiment described herein. As depicted in FIG. 1, the display control circuitry 110 receives input/output via I/O interface circuitry 130 and executes machine-readable instruction sets that are stored or otherwise retained on one or more non-transitory storage devices 140.

The display device 120 may operate at any one of a plurality of display power modes. Each of the plurality of display power modes includes a respective baseline first relationship between the original pixel value distribution and the boosted pixel value distribution (e.g., an upper line segment having a fixed slope ($K_1$) where relatively higher $K_1$ values provide greater power savings and relatively lower $K_1$ values provide lesser power savings); and a content dependent, determined, value representative of a baseline "white" pixel percentage ($X_i$) for in each display image 122. The data associated with each of the plurality of display power modes may be stored in the non-transitory storage device 140 and/or in one or more storage devices disposed at least partially within the display power management control circuitry 110.

In operation, the display power management control circuitry 110 receives information and/or data indicative of the selected display power mode 132 via the I/O interface circuitry 130. In embodiments, the information and/or data indicative of the selected display power mode 132 may be generated autonomously and communicated to the display control circuitry 110. For example, a processor or controller circuit may generate the information and/or data indicative of the selected display power mode 132 based on one or more environmental conditions (e.g., ambient light conditions) and/or one or more system conditions (e.g., power source/battery power level). In embodiments, the information and/or data indicative of the selected display power mode may be provided manually. For example, a system user may manually select a desired display power mode. In response to receipt of information indicative of a desired display power mode 132, the display control circuitry 110 retrieves information and/or data indicative of a baseline first relationship ($K_{1,BASELINE}$) associated with the selected display power mode 132 from the non-transitory storage device 140 and determines a baseline value ($X_{i,BASELINE}$) representative of the percentage of "white" pixels present in a display image 122. In embodiments, the display power management control circuitry 110 first determines a baseline second relationship ($K_{0,BASELINE}$) using the baseline first relationship ($K_{1,BASELINE}$) and the baseline percentage of "white" pixels ($X_{i,BASELINE}$). Using the resultant set of baseline power consumption and pixel color values ($K_{0,BASELINE}$, $K_{1,BASELINE}$, $X_{i,BASELINE}$), the display power management control circuitry 110 then determines one or more baseline image quality parameters ($IQ_{BASELINE}$). The following equations provide an illustrative relationship between the first relationship ($K_1$) the second relationship ($K_0$), and the pixel percentage ($X_i$):

$$K_1=(255-X_1*K_0)/(255-X_1) \quad (1)$$

$$K_0=(255-K_1*(255-X_i))/X_i \quad (2)$$

$$X_i=255*(1-K_1)/(K_0-K_1) \quad (3)$$

After determining $K_{0,BASELINE}$, $K_{1,BASELINE}$, $X_{i,BASELINE}$, and $IQ_{BASELINE}$ the display power management control circuitry 110 then determines a maximum value associated with the second relationship ($K_{0,MAX}$) using equation (2) and setting ($K_1$) equal to a value of zero.

The display power management control circuitry 110 causes the value associated with the second relationship to decrement through a plurality of "n" values ($K_{0,n}$) from ($K_{0,MAX}$) from ($K_{0,MAX}$) to ($K_{0,BASELINE}$). In embodiments, plurality of "n" values ($K_{0,n}$) may include any number of equally or unequally spaced values. For example, the plurality of "n" values may include: 3 or more second relationship ($K_0$) values; 5 or more second relationship ($K_0$) values; 10 or more second relationship ($K_0$) values; 20 or more second relationship ($K_0$) values; 30 or more second relationship ($K_0$) values; 50 or more second relationship ($K_0$) values; or 100 or more second relationship ($K_0$) values. At each value "n" the display power management control circuitry 110 determines a maximum value ($K_{1,n,MAX}$) for the first relationship using ($X_{i,BASELINE}$) and equation (1) above. At each value "n" the display power management control circuitry 110 further decrements the value associated with the first relationship through a plurality of "m" values ($K_{i,n,m}$) from ($K_{1,n,MAX}$) to $K_1$=0. In embodiments, plurality of "m" values ($K_{1,n,m}$) may include any number of equally or unequally spaced values. For example, the plurality of "m" values may include: 3 or more first relationship ($K_1$) values; 5 or more first relationship ($K_1$) values; 10 or more first relationship ($K_1$) values; 20 or more first relationship ($K_1$) values; 30 or more first relationship ($K_1$) values; 50 or more first relationship ($K_1$) values; or 100 or more first relationship ($K_1$) values. Using equation (3), the display power management control circuitry 110 determines a pixel percentage ($X_{i,n,m}$) corresponding to for the display image at each first relationship value, second relationship value pair ($K_{0,n}$, $K_{1,n,m}$).

For each value of "n" and "m," the display power management control circuitry 110 determines one or more corresponding image quality parameters ($IQ_{n,m}$) using the set of values ($K_{0,n}$, $K_{1,n,m}$, $X_{i,n,m}$) to generate n times m sets of image quality values. The display power management control circuitry 110 then compares each set of determined image quality parameters ($IQ_{n,m}$) to the baseline image quality parameters ($IQ_{BASELINE}$). In embodiments, the display power management control circuitry 110 performs the comparison between ($IQ_{n,m}$) and ($IQ_{BASELINE}$) on a per-pixel or pixel-by-pixel basis. The display power management control circuitry 110 then selects the set of image quality parameters ($IQ_{n,m}$) demonstrating one or more closest or identical parameters to the baseline image quality parameters ($IQ_{BASELINE}$). The display power management control circuitry 110 then communicates one or more display settings 112 corresponding to the set of values ($K_{0,n}$, $K_{1,n,m}$, $X_{i,n,m}$) associated with the selected image quality parameter ($IQ_{n,m}$) to the display device 120.

The display control circuitry 110 includes any number and/or combination of currently available and/or future developed electronic components, semiconductor devices, and/or logic elements capable of executing one or more machine executable instruction sets. In embodiments, the display control circuitry 110 may include one or more non-volatile data storage or memory circuits capable of storing the information and/or data indicative of the respective baseline first relationship ($K_{1,BASELINE}$) between the original pixel value distribution and the baseline boosted pixel value distribution of the display image 122. The display power management control circuitry 110 also includes logic, circuitry, or combinations thereof to:

- Determine the percentage of "white" pixel values ($X_{i,BASELINE}$) present in a display image 122 provided by the display device 120;
- Determine the baseline second relationship ($K_{0,BASELINE}$) using equation (2), the baseline first relationship ($K_{1,BASELINE}$), and the baseline percentage of "white" pixels ($X_{i,BASELINE}$);
- Determine the one or more baseline image quality parameters ($IQ_{BASELINE}$) using the resultant set of baseline power consumption and pixel color values ($K_{0,BASELINE}$, $K_{1,BASELINE}$, $X_{i,BASELINE}$);
- Determine a maximum value associated with the second relationship ($K_{0,MAX}$) using equation (2), $X_{i,BASELINE}$, and setting ($K_1$) equal to a value of zero.
- Decrement the second relationship through a plurality of "n" values ($K_{0,n}$) from ($K_{0,MAX}$) to ($K_{0,BASLINE}$);
- Select a plurality of "m" pixel percentages ($X_{i,n,m}$);
- At each of the "n" second relationship values ($K_{0,n}$) and each of the "m" pixel percentages ($X_{i,n,m}$), determine a value associated with the first relationship ($K_{1,n,m}$) from ($K_{1,n,MAX}$);
- Determine one or more corresponding image quality parameters ($IQ_{n,m}$) using the set of values ($K_{0,n}$, $K_{1,n,m}$, $X_{i,n,m}$) for each value of "n" and "m,";
- Compare each set of determined image quality parameters ($IQ_{n,m}$) to the baseline image quality parameters ($IQ_{BASELINE}$) on a per-pixel or pixel-by-pixel basis;
- Select the set of image quality parameters ($IQ_{n,m}$) demonstrating one or more closest or identical parameters to the baseline image quality parameters ($IQ_{BASELINE}$); and
- Communicate one or more display settings 112 corresponding to the set of values ($K_{0,n}$, $K_{1,n,m}$, $X_{i,n,m}$) associated with the selected image quality parameter ($IQ_{n,m}$) to the display device 120.

The display control circuitry 110 may be disposed in whole or in part within a processor-based device such as a smartphone, portable processor-based device, laptop computer, tablet computer, wearable computer, or similar. The display control circuitry 110 may be disposed in whole or in part within the display device 120. The display control circuitry 110 may be disposed in whole or in part within a graphical processing unit (GPU) or similar vector processing circuitry. In embodiments, the display control circuitry 110 may include a stand-alone semiconductor device such as an Application Specific Integrated Circuit (ASIC) or field programmable gate array (FPGA) arranged as a System-on-Chip (SoC) or multi-chip module (MCM).

The display device 120 may include any number and/or combination of electronic components, semiconductor devices, and/or logic elements capable of providing a human perceptible, visual, output. In embodiments, the display device 120 may include one or more touchscreen devices that provide a tactile input as well as a video or visual output. In embodiments, the display device 120 includes one or more I/O interface circuits 124 and/or one or more backlight circuits 126 capable of generating an electromagnetic output corresponding and/or proportional to one of a plurality of display power modes 132A-132*n*. The display device 120 may be disposed in a smartphone, portable computer, wearable computer, tablet computer, laptop computer or netbook. The display device 120 may use any currently available or future developed display technology, such as liquid crystal display (LCD) display technology; light emitting diode (LED) display technology; quantum dot LED (QLED) display technology; polymer LED (PLED) display technology; and similar. The display device 120 may have any display resolution, including but not limited to: 4:3 aspect ratio resolutions (640×480, 800×600, 960×720, 1024×768, 1280×960, 1400×1050, 1440×1080, 1600×1200, 1856×1392, 1920×1440, 2048×1536, etc.); 16:10 aspect ratio resolutions (1200×800, 1440×900, 1680×1050, 1920×1200, 2560×1600, etc.); or any other aspect ratios and/or display resolutions. In embodiments, the display device 120 includes one or more I/O interfaces to receive information and/or data indicative of the display operating mode 112 from the display control circuitry 110.

The I/O interface circuitry 130 includes any number and/or combination of wired I/O interface circuits 134 and/or wireless I/O interface circuits 136. The I/O interface circuitry 130 communicates information and/or data indicative of a defined display power mode 132 to the display control circuitry 110. In embodiments, the display power mode 132 may be autonomously selected. For example, by a system control circuit coupled to one or more sensors and/or sensor arrays, such as an ambient light sensor or sensor array that provides an input used to adjust the brightness of the display device 120. In embodiments, the display power mode 132 may be manually selected. For example, a system user may provide an input indicative of a desired display power mode 132.

The storage device 140 may include any number and/or combination of devices capable of storing information and/or data including one or more machine-readable instruction sets. In embodiments, the storage device 140 may include one or more data stores, data structures, or databases, that store or otherwise retain information and/or data representative of: the first relationship ($K_1$) between the baseline original pixel color value distribution and the baseline boosted pixel color value distribution associated with each respective one of the plurality of display power modes 132A-132*n*.

Figure 2A:
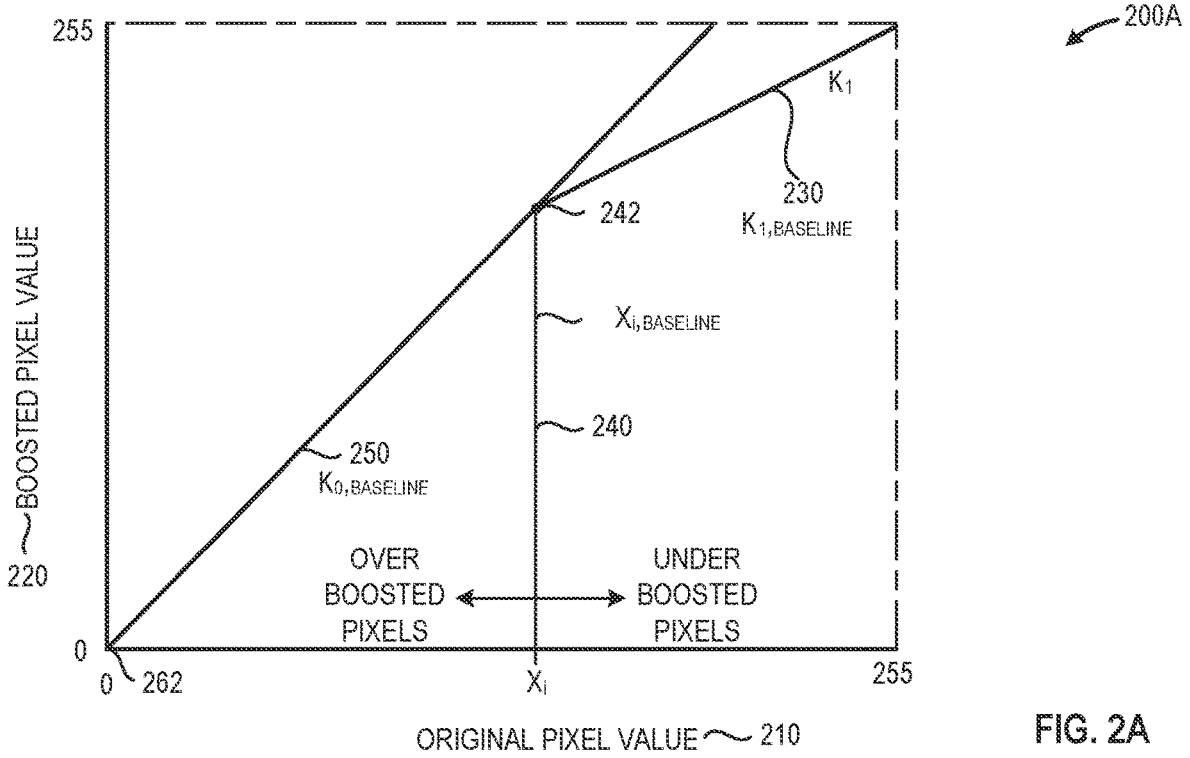
FIG. 2A is a graphical representation of original pixel values against boosted pixel values that depicts an illustrative determination by the display power management control circuitry of a baseline second relationship ($K_{0,BASELINE}$) using a baseline first relationship ($K_{1,BASELINE}$) and a determined value ($X_{i,BASELINE}$) corresponding to the percentage of under-boosted or "white" pixels in a display image presented via a communicatively coupled display device, in accordance with at least one embodiment described herein.

FIG. 2A is a graphical representation 200A of original pixel values 210 against boosted pixel values 220 that depicts an illustrative determination by the display power management control circuitry 110 of a baseline second relationship ($K_{0,BASELINE}$) 250 using a baseline first relationship ($K_{1,BASELINE}$) 230 and a determined value ($X_{i,BASELINE}$) 240 corresponding to the percentage of under-boosted or "white" pixels in a display image 122 presented via a communicatively coupled display device 120, in accordance with at least one embodiment described herein. As depicted in FIG. 2A, the baseline first relationship ($K_{1,BASELINE}$) 230 and the baseline second relationship ($K_{0,BASELINE}$) 250 intersect 242 at the value ($X_{i,BASELINE}$) 240 corresponding to the percentage of "white" pixels in a display image 122. As depicted in FIG. 2A, pixels having color values less than ($X_{i,BASELINE}$) 240 are over-boosted to compensate for the reduced illumination provided by a reduced power backlight 126 and pixels having color vales greater than ($X_{i,BASELINE}$) 240 are under-boosted to compensate for the reduced illumination provided by the backlight 126.

Figure 2B:
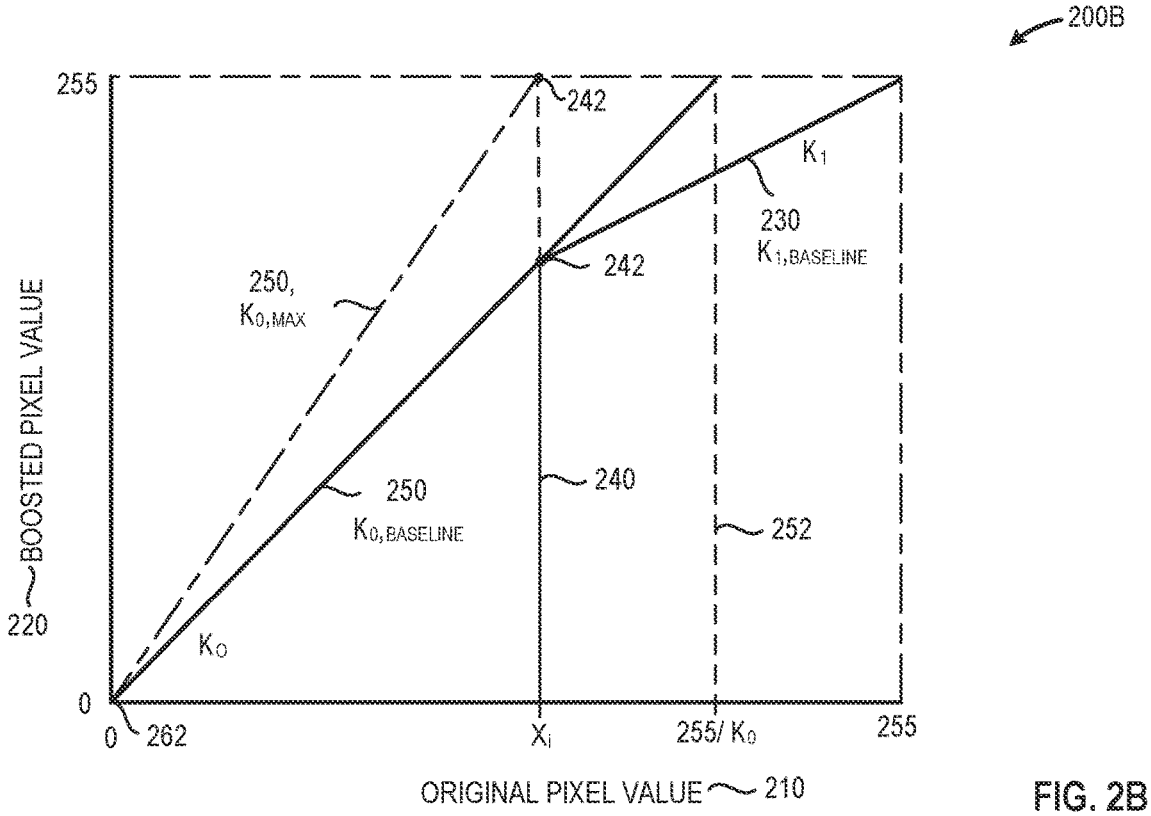
FIG. 2B is a graphical representation of original pixel values against boosted pixel values that depicts the determination of a maximum value associated with the second relationship ($K_{0,MAX}$) using the value corresponding to $X_{i,BASELINE}$, and by setting ($K_1$) equal to a value of zero to establish point, in accordance with at least one embodiment described herein.

FIG. 2B is a graphical representation 200B of original pixel values 210 against boosted pixel values 220 that depicts the determination of a maximum value associated with the second relationship ($K_{0,MAX}$) using the value 240 corresponding to $X_{i,BASELINE}$, and by setting ($K_1$) equal to a value of zero to establish point 242, in accordance with at least one embodiment described herein. In embodiments, the display power management control circuitry 110 may determine the maximum value associated with the second relationship ($K_{0,MAX}$) $\mathbf{250}_1$ using equation (2).

Figure 2C:
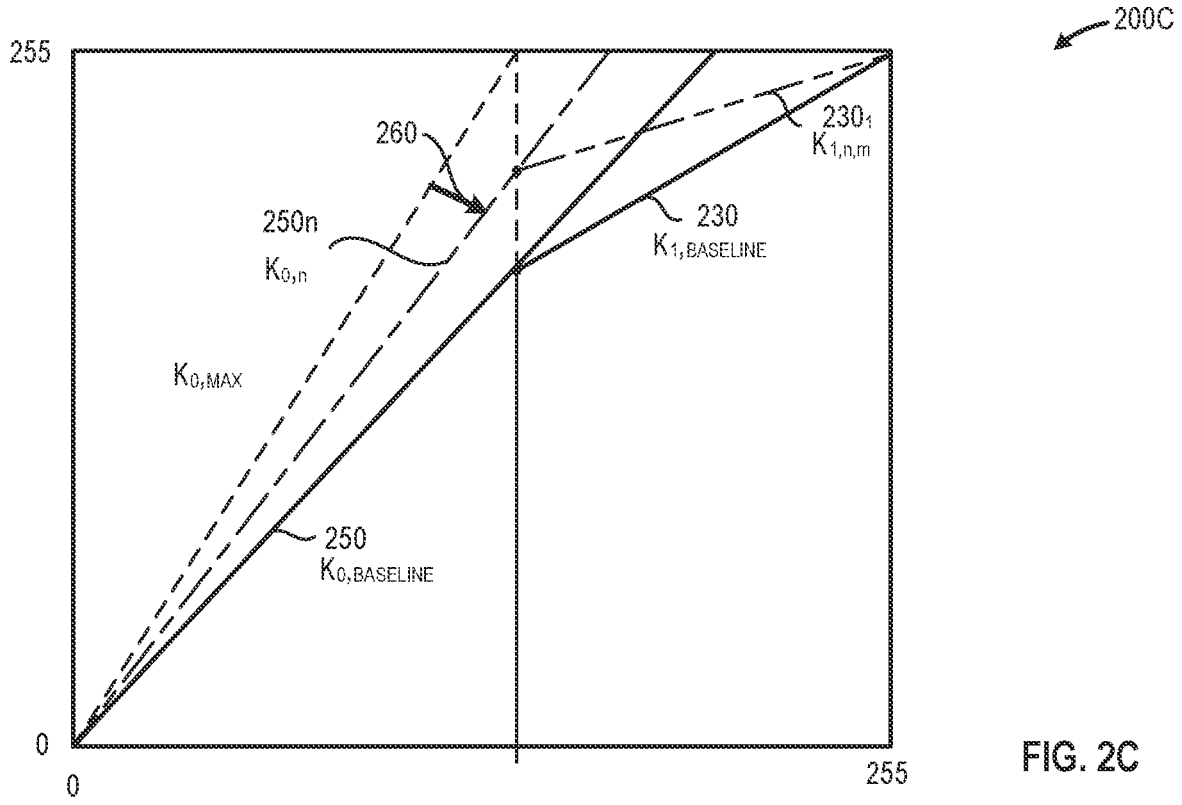
FIG. 2C is a graphical representation of original pixel values against boosted pixel values that depicts decrementing the value associated with the second relationship ($K_{0,n}$) from the maximum value associated with the second relationship ($K_{0,MAX}$) to the value associated with the baseline second relationship ($K_{0,BASELINE}$) to provide a plurality of "n" values representative of the second relationship ($K_{0,\ 1\ .\ .\ .\ n}$), in accordance with at least one embodiment described herein.

FIG. 2C is a graphical representation 200C of original pixel values 210 against boosted pixel values 220 that depicts decrementing 260 the value associated with the second relationship ($K_{0,n}$) from the maximum value associated with the second relationship ($K_{0,MAX}$) $\mathbf{250}_1$ to the value associated with the baseline second relationship ($K_{0,BASELINE}$) 250 to provide a plurality of "n" values representative of the second relationship ($K_{0,\,1\,\ldots\,n}$) $\mathbf{250}_1$-$\mathbf{250}_n$, in accordance with at least one embodiment described herein. For each of the second relationship ($K_{0,n}$) $\mathbf{250}_n$ values, the display power management control circuitry 110 determines a value for the corresponding first relationship ($K_{1,n,1}$) $\mathbf{230}_1$ by substituting the value associated with the second relationship ($K_{0,n}$) $\mathbf{250}_n$, and the value corresponding to $X_{i,BASELINE}$ 240 into equation (1).

In embodiments, the display power management control circuitry 110 implements a gradient descent algorithm. The display power management control circuitry 110 may constrain the second relationship ($K_0$) to a minimum value of ($K_{0,BASELINE}$) and a maximum value ($K_{0,MAX}$) $\mathbf{250}_1$ of ($255/X_{i,BASELINE}$). The value of the second relationship may be decremented using the following relationship:

$$K_{0,n}=255/(X_i+n*K_{0,STEP}) \tag{4}$$

Where:

$0 \le n \le K_0$;

$K_{0,STEP}$ is an adjustable step size to adjust gradient descent and begins with a default value of "1"; and $K_{0,n}$ begins at $K_{0,MAX}$ and decrements to $K_0$ at a speed determined by $K_{0,STEP}$.

Figure 2D:
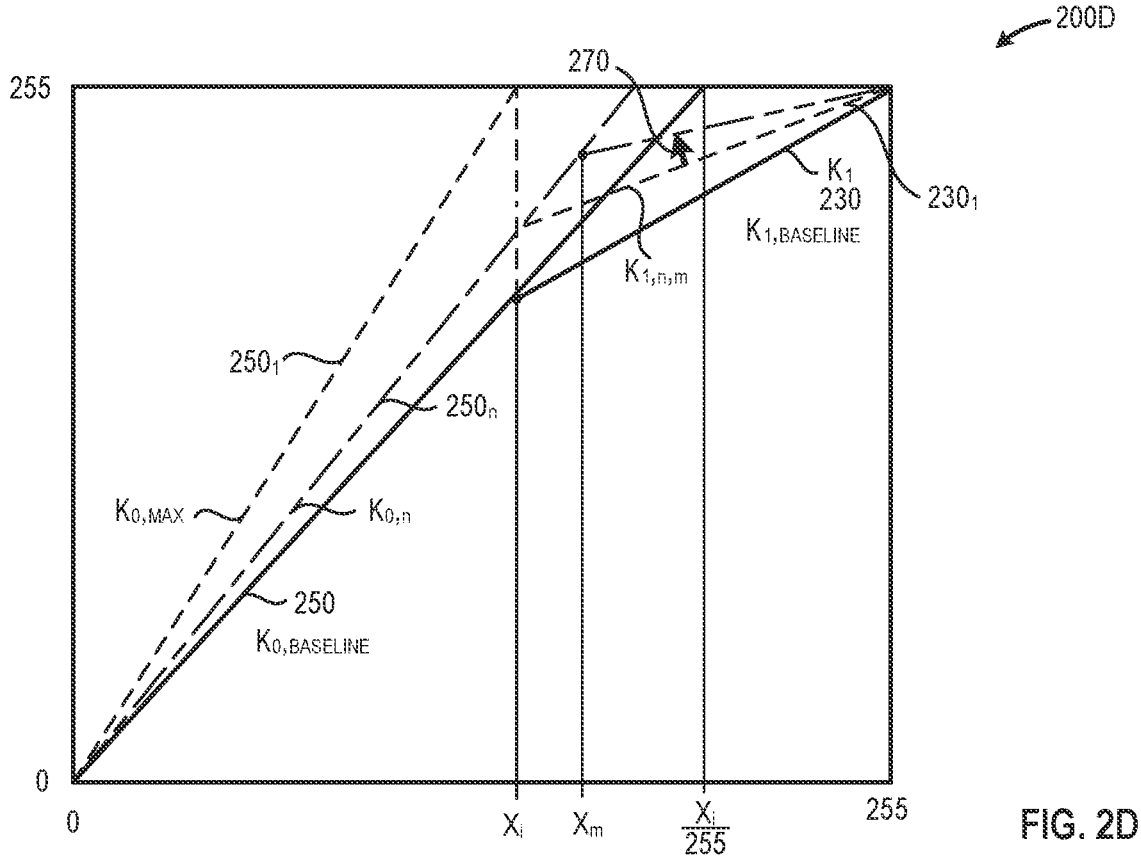
FIG. 2D is a graphical representation of original pixel values against boosted pixel values that depicts decrementing the value associated with the first relationship ($K_{1,m}$) from the baseline value associated with the first relationship ($K_{1,BASELINE}$) to $K_1$=0 to provide a plurality of "m" values representative of the first relationship ($K_{1,\ 1\ .\ .\ .\ m}$) for each corresponding second relationship value ($K_{0,n}$), in accordance with at least one embodiment described herein.

FIG. 2D is a graphical representation 200D of original pixel values 210 against boosted pixel values 220 that depicts decrementing 270 the value associated with the first relationship ($K_{1,m}$) from the baseline value associated with the first relationship ($K_{1,BASELINE}$) $\mathbf{230}_1$ to $K_1=0$ to provide a plurality of "m" values representative of the first relationship ($K_{1,\,1\,\ldots\,m}$) $\mathbf{230}_1$-$\mathbf{230}_m$ for each corresponding second relationship value ($K_{0,n}$) $\mathbf{250}_n$, in accordance with at least one embodiment described herein. For each of "m" first relationship values ($K_{1,\,1\,\ldots\,m}$) at each of the "n" second relationship values ($K_{0,n}$), the display power management control circuitry 110 determines one or more image quality parameters associated with the display image 122.

In embodiments, the display power management control circuitry 110 determine values of the first relationship ($K_{1,m}$) by varying the value representative of the percentage pixels having a "white" color value. In such embodiments, the display power management control circuitry 110 may constrain the pixel percentage ($X_{i,m}$) to a minimum value of ($X_{i,BASELINE}$) and a maximum value ($255/X_{i,BASELINE}$). The value of the pixel percentage ($X_{i,m}$) may be decremented using the following relationship:

$$X_{i,m}=X_{i+m}*X_{i,STEP} \tag{5}$$

Where:

$K_{1,m}$ determined using $X_{i,m}$ and $K_{0,n}$ $X_{i,STEP}$ is an adjustable step size to adjust gradient descent of $K_{1,m}$ and begins with a default value of "1"; and $K_{1,n,m}$ begins at $(255-X_1*K_{0,n})/(255-X_i)$ and decrements to 0 at a speed determined by $X_{i,STEP}$ In embodiments, the image quality parameters may include a value indicative of brightness distortion using the following relationship:

$$\text{LOSS}=\Sigma_{x=x1+1}^{255}(f(x)-x)^2*h(x) \tag{6}$$

Where:

x=brightness value under normal backlight h(x) is the number of pixels at "x" brightness value;

$f(x)=X_i+K_1(x-X_i)/K_0$ (distorted brightness value under normal backlight)

Figure 3:
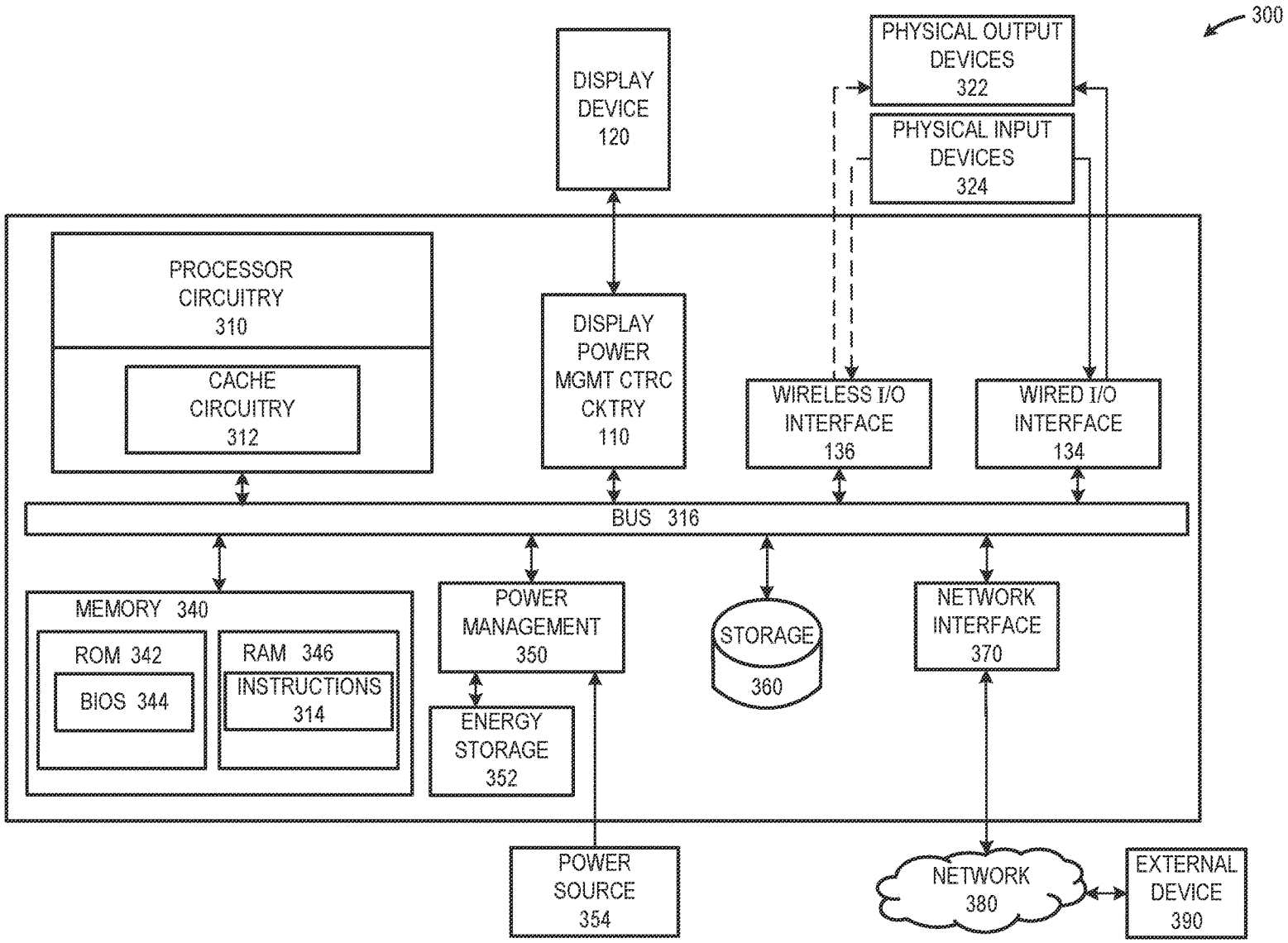
FIG. 3 is a schematic diagram of an illustrative electronic, processor-based, device that includes display control circuitry to reduce the power consumption of a communicatively coupled display device at each of a plurality of display power modes, in accordance with at least one embodiment described herein.

FIG. 3 is a schematic diagram of an illustrative electronic, processor-based, device 300 that includes display control circuitry 110 to reduce the power consumption of a communicatively coupled display device 120 at each of a plurality of display power modes 132A-132*n*, in accordance with at least one embodiment described herein. The processor-based device 300 may additionally include one or more of the following: processor circuitry 310, processor cache circuitry 312, system memory 340, power management circuitry 350, a non-transitory storage device 360, and a network interface 370. The following discussion provides a brief, general description of the components forming the illustrative processor-based device 300. Example, non-limiting processor-based devices 300 may include, but are not limited to: smartphones, wearable computers, portable computing devices, handheld computing devices, desktop computing devices, servers, blade server devices, workstations, and similar.

In some embodiments, the processor-based device 300 includes graphics processor circuitry 312 capable of executing machine-readable instruction sets and generating an output signal capable of providing a display output to a system user. Those skilled in the relevant art will appreciate that the illustrated embodiments as well as other embodiments may be practiced with other processor-based device configurations, including portable electronic or handheld electronic devices, for instance smartphones, portable computers, wearable computers, consumer electronics, personal computers ("PCs"), network PCs, minicomputers, server blades, mainframe computers, and the like. The processor circuitry 120 may include any number of hardwired or configurable circuits, some or all of which may include programmable and/or configurable combinations of electronic components, semiconductor devices, and/or logic elements that are disposed partially or wholly in a PC, server, or other computing system capable of executing machine-readable instructions.

The processor-based device 300 includes a bus or similar communications link 316 that communicably couples and facilitates the exchange of information and/or data between various system components including the processor circuitry 310, the display control circuitry 110, one or more wired I/O interfaces 134, one or more wireless I/O interfaces 136, the system memory 170, one or more storage devices 360, and/or one or more network interfaces 370. The processor-based device 300 may be referred to in the singular herein, but this is not intended to limit the embodiments to a single processor-based device 300, since in certain embodiments, there may be more than one processor-based device 300 that incorporates, includes, or contains any number of communicably coupled, collocated, or remote networked circuits or devices.

The processor circuitry 310 may include any number, type, or combination of currently available or future developed devices capable of executing machine-readable instruction sets. The processor circuitry 310 may include but is not limited to any current or future developed single- or multi-core processor or microprocessor, such as: on or more systems on a chip (SOCs); central processing units (CPUs); digital signal processors (DSPs); graphics processing units (GPUs); application-specific integrated circuits (ASICs), programmable logic units, field programmable gate arrays (FPGAs), and the like. Unless described otherwise, the construction and operation of the various blocks shown in FIG. 3 are of conventional design. Consequently, such blocks need not be described in further detail herein, as they will be understood by those skilled in the relevant art. The bus 316 that interconnects at least some of the components of the processor-based device 300 may employ any currently available or future developed serial or parallel bus structures or architectures.

The system memory 340 may include read-only memory ("ROM") 342 and random access memory ("RAM") 346. A portion of the ROM 342 may be used to store or otherwise retain a basic input/output system ("BIOS") 344. The BIOS 344 provides basic functionality to the processor-based device 300, for example by causing the processor circuitry 310 to load and/or execute one or more machine-readable instruction sets 314. In embodiments, at least some of the one or more machine-readable instruction sets cause at least a portion of the processor circuitry 310 to provide, create, produce, transition, and/or function as a dedicated, specific, and particular machine, for example a word processing machine, a digital image acquisition machine, a media playing machine, a gaming system, a communications device, a smartphone, an autonomous vehicle control system, or similar.

The processor-based device 300 may include at least one wireless input/output (I/O) interface 136. The at least one wireless I/O interface 136 may be communicably coupled to one or more physical output devices 322 (tactile devices, video displays, audio output devices, hardcopy output devices, etc.). The at least one wireless I/O interface 136 may communicably couple to one or more physical input devices 324 (pointing devices, touchscreens, keyboards, tactile devices, etc.). The at least one wireless I/O interface 136 may include any currently available or future developed wireless I/O interface. Example wireless I/O interfaces 136 include, but are not limited to: BLUETOOTH®, near field communication (NFC), and similar.

The processor-based device 300 may include one or more wired input/output (I/O) interfaces 134. The at least one wired I/O interface 134 may be communicably coupled to one or more physical output devices 322 (tactile devices, video displays, audio output devices, hardcopy output devices, etc.). The at least one wired I/O interface 134 may be communicably coupled to one or more physical input devices 324 (pointing devices, touchscreens, keyboards, tactile devices, etc.). The wired I/O interface 134 may include any currently available or future developed I/O interface. Example wired I/O interfaces 134 include but are not limited to: universal serial bus (USB), IEEE 1394 ("FireWire"), and similar.

The processor-based device 300 may include one or more communicably coupled, non-transitory, data storage devices 360. The data storage devices 360 may include one or more hard disk drives (HDDs) and/or one or more solid-state storage devices (SSDs). The one or more data storage devices 360 may include any current or future developed storage appliances, network storage devices, and/or systems. Non-limiting examples of such data storage devices 360 may include, but are not limited to, any current or future developed non-transitory storage appliances or devices, such as one or more magnetic storage devices, one or more optical storage devices, one or more electro-resistive storage devices, one or more molecular storage devices, one or more quantum storage devices, or various combinations thereof. In some implementations, the one or more data storage devices 360 may include one or more removable storage devices, such as one or more flash drives, flash memories, flash storage units, or similar appliances or devices capable of communicable coupling to and decoupling from the processor-based device 300.

The one or more data storage devices 360 may include interfaces or controllers (not shown) communicatively coupling the respective storage device or system to the bus 316. The one or more data storage devices 360 may store, retain, or otherwise contain machine-readable instruction sets, data structures, program modules, data stores, databases, logical structures, and/or other data useful to the processor circuitry 310 and/or one or more applications executed on or by the processor circuitry 310. In some instances, one or more data storage devices 360 may be communicably coupled to the processor circuitry 310, for example via the bus 316 or via one or more wired communications interfaces 134 (e.g., Universal Serial Bus or USB); one or more wireless communications interfaces 136 (e.g., Bluetooth®, Near Field Communication or NFC); and/or one or more network interfaces 370 (IEEE 802.3 or Ethernet, IEEE 802.11, or WiFi®, etc.).

The processor-based device 300 may include power management circuitry 350 that controls one or more operational aspects of the energy storage device 352. In embodiments, the energy storage device 352 may include one or more primary (i.e., non-rechargeable) or secondary (i.e., rechargeable) batteries or similar energy storage devices. In embodiments, the energy storage device 352 may include one or more supercapacitors or ultracapacitors. In embodiments, the power management circuitry 350 may alter, adjust, or control the flow of energy from an external power source 354 to the energy storage device 352 and/or to the processor-based device 300. The power source 354 may include, but is not limited to, a solar power system, a commercial electric grid, a portable generator, an external energy storage device, or any combination thereof.

For convenience, the processor circuitry 310, the storage device 360, the system memory 340, the wireless I/O interface 136, the wired I/O interface 134, the power management circuitry 350, and the network interface 370 are illustrated as communicatively coupled to each other via the bus 316, thereby providing connectivity between the above-described components. In alternative embodiments, the above-described components may be communicatively coupled in a different manner than illustrated in FIG. 3. For example, one or more of the above-described components may be directly coupled to other components, or may be coupled to each other, via one or more intermediary components (not shown). In some embodiments, all or a portion of the bus 316 may be omitted and the components are coupled directly to each other using suitable wired or wireless connections.

Figure 4:
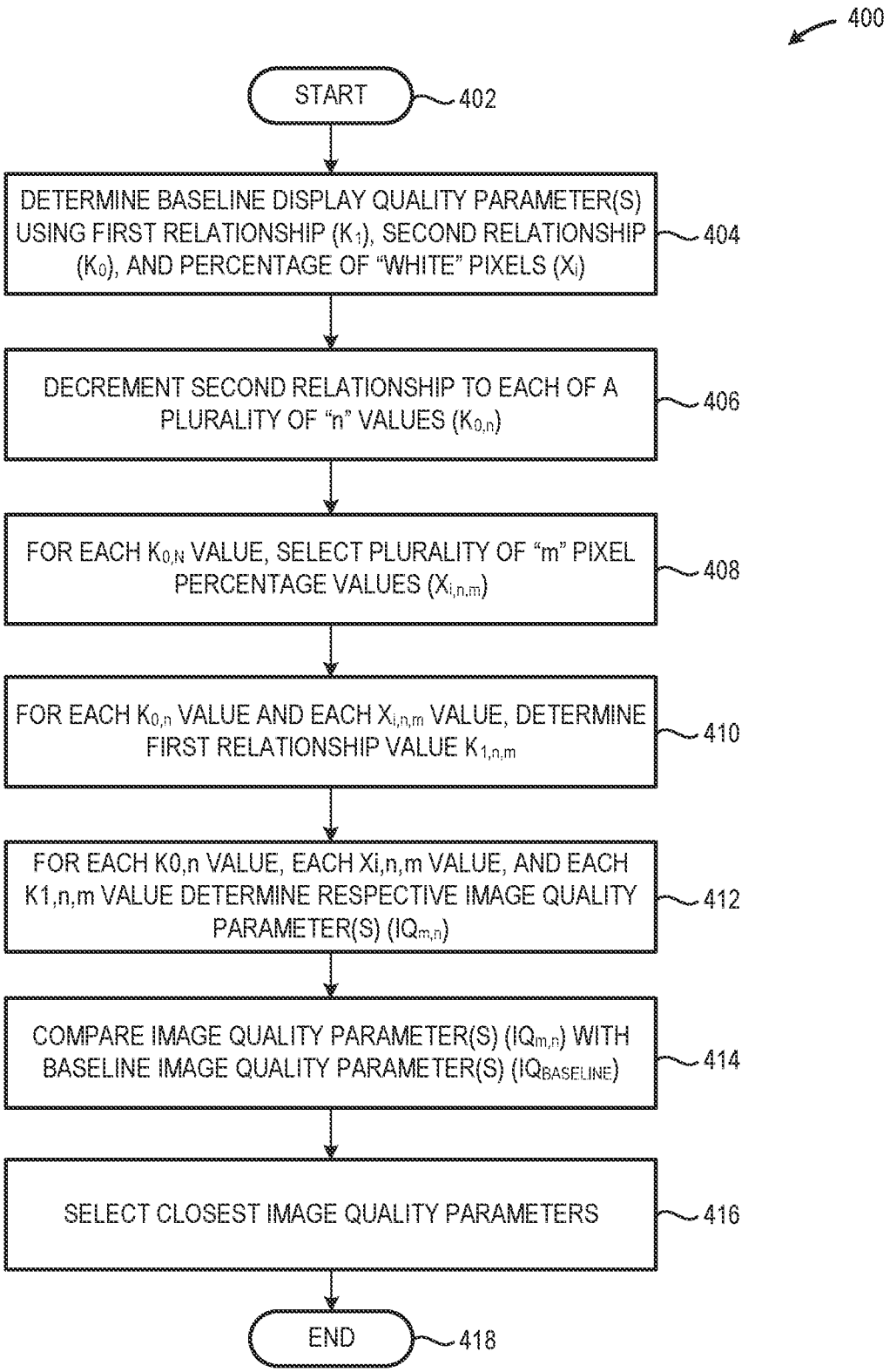
FIG. 4 is a high-level logic flow diagram of an illustrative method of reducing the power consumption of a display device at each of a plurality of power settings, in accordance with at least one embodiment described herein. In embodiments, a display device Although the following Detailed Description will proceed with reference being made to illustrative embodiments, many alternatives, modifications and variations thereof will be apparent to those skilled in the art.

FIG. 4 is a high-level logic flow diagram of an illustrative method 400 of reducing the power consumption of a display device 120 at each of a plurality of power settings 132A-132*n*, in accordance with at least one embodiment described herein. In embodiments, a display device 120 operates in one of a plurality of display power modes 132A-132*n*. For example, a display device 120 may be manually or autonomously selectively placed in one of five (5) different display power modes 132A-132E, with each of the display power modes 132 presenting a different power draw/consumption on the system. A respective baseline first relationship is ($K_{1,BASELINE}$) 230 is associated with each of the plurality of display power modes 132A-132*n*. The baseline first relationship ($K_{1,BASELINE}$) 230 and a baseline percentage of "white" pixels ($X_{i,BASELINE}$) 240 included a display image 122 may define a baseline second relationship ($K_0$). In embodiments, the baseline first relationship ($K_{1,BASELINE}$) 230, the baseline percentage of "white" pixels ($X_{i,BASELINE}$) 240, and the baseline second relationship ($K_{0,BASELINE}$) 250 may be used to characterize baseline image quality parameters ($IQ_{BASELINE}$). The method 400 commences at 402.

At 404, the display power management control circuitry 110 determines a baseline first relationship ($K_{1,BASELINE}$) 230 using information and/or data indicative of a desired display power mode 132 associated with a communicatively coupled display device 120. The display power management control circuitry also determines a baseline percentage of "white" pixels ($X_{i,BASELINE}$) 240 present in a display image 122. Using the baseline first relationship ($K_{1,BASELINE}$) 230 and the baseline percentage of "white" pixels ($X_{i,BASELINE}$) 240, the display power management control circuitry 110 determines a baseline second relationship ($K_{0,BASELINE}$) 250. In embodiments, the display power management control circuitry 110 may determine the baseline second relationship ($K_{0,BASELINE}$) 250 using the following formula:

$$K_0=(255-K_1*(255-X_i))/X_i \tag{7}$$

At 406, the display power management control circuitry 110 determines a maximum value of the second relationship ($K_{0,MAX}$) $\mathbf{250}_1$ using equation (7) and setting the first relationship value ($K_1$) 230 equal to a value of "0." The display power management control circuitry 110 then decrements the value of the second relationship value to each of a plurality of values ($K_{0,n}$) $\mathbf{250}_n$. In embodiments, the value of the second relationship ($K_{0,n}$) may be decremented using the following relationship $$K_{0,n}=255/(X_i+n*K_{0,STEP}) \tag{8}$$

Where:

$0 \le n \le K_0$;

$K_{0,STEP}$ is an adjustable step size to adjust gradient descent and begins with a default value of "1"; and $K_{0,n}$ begins at $K_{0,MAX}$ and decrements to $K_0$ at a speed determined by $K_{0,STEP}$.

At 408, for each of the "n" second relationship values ($K_{0,n}$), the display power management control circuitry 110 selects a plurality of "m" pixel percentage values ($X_{i,m}$). The value of the pixel percentage ($X_{i,m}$) may be decremented using the following relationship:

$$X_{i,m}X_{i,m}*X_{i,STEP} \tag{9}$$

Where:

$K_{1,m}$ determined using $X_{i,m}$ and $K_{0,n}$ $X_{i,STEP}$ is an adjustable step size to adjust gradient descent of $K_{1,m}$ and begins with a default value of "1"; and $K_{1,n,m}$ begins at $(255-X_1*K_{0,n})/(255-X_i)$ and decrements to 0 at a speed determined by $X_{i,STEP}$.

At 410, the display power management control circuitry 110 determines the first relationship value ($K_{1,n,m}$) corresponding to the $n^{th}$ second relationship value ($K_{0,n}$) and each of the "m" plurality of pixel percentage values ($X_{i,m}$). In embodiments, the display power management control circuitry 110 determines the first relationship value ($K_{1,n,m}$) using the following formula:

$$K_{1,n,m}=(255-X_{i,m}*K_{0,n})/(255-X_{i,m}) \tag{10}$$

At 412, the display power management control circuitry 110 determines one or more image quality parameters ($IQ_{n,m}$) associated with the combination of the $m^{th}$ first relationship value ($K_{1,n,m}$), the $n^{th}$ second relationship value ($K_{0,n}$), and the respective $m^{th}$ pixel percentage value ($X_{i,m}$). In embodiments, the display power management control circuitry 110 may determine the one or more image quality parameters ($IQ_{n,m}$) using a value indicative of brightness distortion using the following relationship:

$$LOSS=\Sigma_{x=x1+1}^{255}(f(x)-x)^2*h(x) \tag{11}$$

Where:

x=brightness value under normal backlight h(x) is the number of pixels at "x" brightness value;

$f(x)=X_i+K_1(x-X_i)/K_0$ (distorted brightness value under normal backlight):

At 414, the display power management control circuitry compares each of the determined image quality parameter(s) ($IQ_{n,m}$) with the baseline image quality parameters ($IQ_{BASELINE}$).

At 416, the display power management control circuitry selects the image quality parameter ($IQ_{n,m}$) having the closest value to the baseline image quality parameter ($IQ_{BASELINE}$), determines the corresponding display parameters associated with the selected image quality parameter ($IQ_{n,m}$) and communicates the display parameters 112 to the communicatively coupled display device 120. The method 400 concludes at 418.

While FIG. 4 illustrates various operations according to one or more embodiments, it is to be understood that not all of the operations depicted in FIG. 4 are necessary for other embodiments. Indeed, it is fully contemplated herein that in other embodiments of the present disclosure, the operations depicted in FIG. 4, and/or other operations described herein, may be combined in a manner not specifically shown in any of the drawings, but still fully consistent with the present disclosure. Thus, claims directed to features and/or operations that are not exactly shown in one drawing are deemed within the scope and content of the present disclosure.

As used in this application and in the claims, a list of items joined by the term "and/or" can mean any combination of the listed items. For example, the phrase "A, B and/or C" can mean A; B; C; A and B; A and C; B and C; or A, B and C. As used in this application and in the claims, a list of items joined by the term "at least one of" can mean any combination of the listed terms. For example, the phrases "at least one of A, B or C" can mean A; B; C; A and B; A and C; B and C; or A, B and C.

As used in any embodiment herein, the terms "system" or "module" may refer to, for example, software, firmware and/or circuitry configured to perform any of the aforementioned operations. Software may be embodied as a software package, code, instructions, instruction sets and/or data recorded on non-transitory computer readable storage mediums. Firmware may be embodied as code, instructions or instruction sets and/or data that are hard-coded (e.g., non-volatile) in memory devices.

As used in any embodiment herein, the terms "circuit" and "circuitry" may comprise, for example, singly or in any combination, hardwired circuitry, programmable circuitry such as computer processors comprising one or more individual instruction processing cores, state machine circuitry, and/or firmware that stores instructions executed by programmable circuitry or future computing paradigms including, for example, massive parallelism, analog or quantum computing, hardware embodiments of accelerators such as neural net processors and non-silicon implementations of the above. The circuitry may, collectively or individually, be embodied as circuitry that forms part of a larger system, for example, an integrated circuit (IC), system on-chip (SoC), desktop computers, laptop computers, tablet computers, servers, smartphones, etc.

Any of the operations described herein may be implemented in a system that includes one or more mediums (e.g., non-transitory storage mediums) having stored therein, individually or in combination, instructions that when executed by one or more processors perform the methods. Here, the processor may include, for example, a server CPU, a mobile device CPU, and/or other programmable circuitry. Also, it is intended that operations described herein may be distributed across a plurality of physical devices, such as processing structures at more than one different physical location. The storage medium may include any type of tangible medium, for example, any type of disk including hard disks, floppy disks, optical disks, compact disk read-only memories (CD-ROMs), compact disk rewritables (CD-RWs), and magneto-optical disks, semiconductor devices such as read-only memories (ROMs), random access memories (RAMs) such as dynamic and static RAMs, erasable programmable read-only memories (EPROMs), electrically erasable programmable read-only memories (EEPROMs), flash memories, Solid State Disks (SSDs), embedded multimedia cards (eMMCs), secure digital input/output (SDIO) cards, magnetic or optical cards, or any type of media suitable for storing electronic instructions. Other embodiments may be implemented as software executed by a programmable control device.

Thus, the present disclosure is directed to systems and methods for reducing display image power consumption while maintaining image quality on display devices having a plurality of display power modes. Each display power mode has associated therewith a defined baseline value ($K_{1,BASELINE}$) first relationship. A display image includes a baseline percentage under-boosted pixels ($X_{i,BASELINE}$). Using the first relationship value ($K_{1,BASELINE}$) and the pixel percentage ($X_{i,BASELINE}$), a baseline second relationship value is determined ($K_{0,BASELINE}$). The value associated with the second relationship is adjusted to a first plurality of values. At each value, the value associated with the pixel percentage is adjusted to each of a second plurality of values. At each combination of second relationship value and pixel percentage, a respective first relationship value is determined. A first relationship value, second relationship value are selected to provide a reduced power consumption while maintaining image quality.

The following examples pertain to further embodiments. The following examples of the present disclosure may comprise subject material such as at least one device, a method, at least one machine-readable medium for storing instructions that when executed cause a machine to perform acts based on the method, means for performing acts based on the method and/or a system for reducing display image power consumption while maintaining image quality on display devices having a plurality of display power modes.

According to example 1, there is provided a display power reduction system. The system may include: display interface circuitry to receive data representative of one or more parameters from each of one or more pixels forming a display image on a display device; display power management control circuitry coupled to the display interface circuitry, the display power management control circuitry to: determine one or more image quality (IQ) parameters for a baseline display power mode ($IQ_{BASELINE}$) using: a baseline first parameter ($K_{1,BASELINE}$) associated with a baseline first relationship between a baseline number of original pixel values and a baseline number of boosted pixel values used to form the display image; a baseline percentage of the plurality of pixels ($X_{i,BASELINE}$) having a defined color value; a baseline second parameter ($K_{0,BASELINE}$) associated with a baseline second relationship between the baseline number of original pixel values and a baseline number of boosted pixel values; adjust the second parameter to each of a plurality of second parameter values ($K_{0,1-n}$) and, for each of the plurality of second parameter values ($K_{0,n}$): adjust the percentage of pixels having the defined color value to a plurality of pixel percentages ($X_{i,1-m}$); determine the value of the first parameter at each of the plurality of pixel percentages using the second parameter value ($K_{0,n}$) and the respective pixel percentage value ($X_{i,m}$); and determine the one or more image quality parameters ($IQ_{n,m}$); and select a first parameter, second parameter pair ($K_{0,n}$, $K_{1,m}$) associated with the one or more IQ parameters ($IQ_{m,n}$) closest to the one or more baseline IQ parameters ($IQ_{BASELINE}$).

Example 2 may include elements of example 1 where the display power management control circuitry receives data representative of a baseline display power mode that includes: data indicative of a value representative of the percentage of pixels having the defined color value ($X_{i,BASELINE}$); wherein the baseline first relationship ($K_{1,BASELINE}$) shares a common value with the baseline second relationship ($K_{0,BASELINE}$) at the value representative of the percentage of pixels having the defined color value ($X_{i,BASELINE}$).

Example 3 may include elements of any of examples 1 or 2, and the display power management control circuitry may further determine the one or more image quality (IQ) parameters for the baseline display power mode ($IQ_{BASELINE}$) using a first parameter ($K_{1,BASELINE}$) associated with a linear baseline first relationship.

Example 4 may include elements of any of examples 1 through 3, and the display power management control circuitry may further: determine the one or more image quality (IQ) parameters for a baseline display power mode ($IQ_{BASELINE}$) using a slope ($K_{1,BASELINE}$) associated with a linear baseline first relationship.

Example 5 may include elements of any of examples 1 through 4, and the display power management control circuitry may further determine the one or more image quality (IQ) parameters for a baseline display power mode ($IQ_{BASELINE}$) using a second parameter ($K_{0,BASELINE}$) associated with a linear baseline second relationship.

Example 6 may include elements of any of examples 1 through 5, and the display power management control circuitry may further: determine the one or more image quality (IQ) parameters for a baseline display power mode ($IQ_{BASELINE}$) using a slope ($K_{0,BASELINE}$) associated with a linear baseline second relationship.

Example 7 may include elements of any of examples 1 through 6, and the display power management control circuitry may further: determine the one or more image quality (IQ) parameters for a baseline display power mode ($IQ_{BASELINE}$) on a per-pixel basis.

Example 8 may include elements of any of examples 1 through 7, and the display power management control circuitry may further: determine the one or more IQ parameters ($IQ_{n,m}$) representative of the display image provided by the selected first parameter and the selected second parameter pair ($K_{1,m}$, $K_{0,n}$) on a per-pixel basis.

According to example 9, there is provided a display power reduction method. The method may include: determining, by the display power management control circuitry, one or more image quality (IQ) parameters for a baseline display power mode ($IQ_{BASELINE}$) using: a baseline first parameter ($K_{1,BASELINE}$) associated with a baseline first relationship between a baseline number of original pixel values and a baseline number of boosted pixel values used to form the display image; a baseline percentage of the plurality of pixels ($X_{i,BASELINE}$) having a defined color value; a baseline second parameter ($K_{0,BASELINE}$) associated with a baseline second relationship between the baseline number of original pixel values and a baseline number of boosted pixel values; adjusting, by the display power management control circuitry, the second parameter to each of a plurality of second parameter values ($K_{0,1-n}$) and, for each of the plurality of second parameter values ($K_{0,n}$): adjusting, by the display power management control circuitry, the percentage of pixels having the defined color value to a plurality of pixel percentages ($X_{i,1-m}$); determining, by the display power management control circuitry, the value of the first parameter at each of the plurality of pixel percentages using the second parameter value ($K_{0,n}$) and the respective pixel percentage value ($X_{i,m}$); and determining, by the display power management control circuitry, the one or more image quality parameters ($IQ_{n,m}$); and selecting, by the display power management control circuitry, a first parameter, second parameter pair ($K_{0,n}$, $K_{1,m}$) associated with the one or more IQ parameters ($IQ_{m,n}$) closest to the one or more baseline IQ parameters ($IQ_{BASELINE}$).

Example 10 may include elements of example 9, and the method may further include: receiving, by the display power management control circuitry, data representative of a baseline display power mode that includes: data indicative of a value representative of the percentage of pixels having the defined color value ($X_{i,BASELINE}$); wherein the baseline first relationship ($K_{1,BASELINE}$) shares a common value with the baseline second relationship ($K_{0,BASELINE}$) at the value representative of the percentage of pixels having the defined color value ($X_{i,BASELINE}$).

Example 11 may include elements of any of examples 9 or 10 where determining one or more image quality (IQ) parameters for the baseline display power mode ($IQ_{BASELINE}$) using: the baseline first parameter ($K_{1,BASELINE}$) associated with the baseline first relationship; the baseline percentage of the plurality of pixels ($X_{i,BASELINE}$) having the defined color value; and the baseline second parameter ($K_{0,BASELINE}$) associated with the baseline second relationship further comprises: determining, by the display power management control circuitry, the one or more image quality (IQ) parameters for the baseline display power mode ($IQ_{BASELINE}$) using a first parameter ($K_{1,BASELINE}$) associated with a linear baseline first relationship.

Example 12 may include elements of any of examples 9 through 11 where determining the one or more image quality (IQ) parameters for the baseline display power mode (IQBASELINE) using the first parameter (K1,BASELINE) associated with the linear baseline first relationship further comprises: determine the one or more image quality (IQ) parameters for a baseline display power mode ($IQ_{BASELINE}$) using a slope ($K_{1,BASELINE}$) associated with a linear baseline first relationship.

Example 13 may include elements of any of examples 9 through 12 where determining one or more image quality (IQ) parameters for the baseline display power mode ($IQ_{BASELINE}$) using: the baseline first parameter ($K_{1,BASELINE}$) associated with the baseline first relationship; the baseline percentage of the plurality of pixels ($X_{i,BASELINE}$) having the defined color value; and the baseline second parameter ($K_{0,BASELINE}$) associated with the baseline second relationship further comprises: determining, by the display power management control circuitry, the one or more image quality (IQ) parameters for a baseline display power mode ($IQ_{BASELINE}$) using a second parameter ($K_{0,BASELINE}$) associated with a linear baseline second relationship.

Example 14 may include elements of any of examples 9 through 13 where determining the one or more image quality (IQ) parameters for a baseline display power mode ($IQ_{BASELINE}$) using a second parameter ($K_{0,BASELINE}$) associated with a linear baseline second relationship further comprises: determining, by the display power management control circuitry, the one or more image quality (IQ) parameters for a baseline display power mode ($IQ_{BASELINE}$) using a slope ($K_{0,BASELINE}$) associated with a linear baseline second relationship.

Example 15 may include elements of any of examples 9 through 14 where determining the one or more image quality (IQ) parameters for a baseline display power mode ($IQ_{BASELINE}$) further comprises: determining, by the display power management control circuitry, the one or more image quality (IQ) parameters for a baseline display power mode ($IQ_{BASELINE}$) on a per-pixel basis.

Example 16 may include elements of any of examples 9 through 15 where determining the one or more image quality (IQ) parameters for a baseline display power mode ($IQ_{BASELINE}$) on a per-pixel basis further comprises: determining, by the display power management control circuitry, the one or more IQ parameters ($IQ_{n,m}$) representative of the display image provided by the selected first parameter and the selected second parameter pair ($K_{1,m}$, $K_{0,n}$) on a per-pixel basis.

According to example 17, there is provided a non-transitory storage device. The non-transitory storage device may include instructions that, when executed by display power management control circuitry, causes the display power management control circuitry to: determine one or more image quality (IQ) parameters for a baseline display power mode ($IQ_{BASELINE}$) using: a baseline first parameter ($K_{1,BASELINE}$) associated with a baseline first relationship between a baseline number of original pixel values and a baseline number of boosted pixel values used to form the display image; a baseline percentage of the plurality of pixels ($X_{i,BASELINE}$) having a defined color value; a baseline second parameter ($K_{0,BASELINE}$) associated with a baseline second relationship between the baseline number of original pixel values and a baseline number of boosted pixel values; adjust the second parameter to each of a plurality of second parameter values ($K_{0,1-n}$) and, for each of the plurality of second parameter values ($K_{0,n}$): adjust the percentage of pixels having the defined color value to a plurality of pixel percentages ($X_{i,1-m}$); determine the value of the first parameter at each of the plurality of pixel percentages using the second parameter value ($K_{0,n}$) and the respective pixel percentage value ($X_{i,m}$); and determine the one or more image quality parameters ($IQ_{n,m}$); and select a first parameter, second parameter pair ($K_{0,n}$, $K_{1,m}$) associated with the one or more IQ parameters ($IQ_{m,n}$) closest to the one or more baseline IQ parameters ($IQ_{BASELINE}$).

Example 18 may include elements of example 17 where the instructions, when executed by the display power management control circuitry, further cause the display power management control circuitry to: receive data representative of a baseline display power mode that includes: data indicative of a value representative of the percentage of pixels having the defined color value ($X_{i,BASELINE}$); where the baseline first relationship ($K_{1,BASELINE}$) shares a common value with the baseline second relationship ($K_{0,BASELINE}$) at the value representative of the percentage of pixels having the defined color value ($X_{i,BASELINE}$).

Example 19 may include elements of any of examples 17 or 18 where the instructions that cause the display power management control circuitry to determine the one or more image quality (IQ) parameters for the baseline display power mode ($IQ_{BASELINE}$) using: the baseline first parameter ($K_{1,BASELINE}$) associated with the baseline first relationship; the baseline percentage of the plurality of pixels ($X_{i,BASELINE}$) having the defined color value; and the baseline second parameter ($K_{0,BASELINE}$) associated with the baseline second relationship further cause the display power management control circuitry to: determine the one or more image quality (IQ) parameters for the baseline display power mode ($IQ_{BASELINE}$) using a first parameter ($K_{1,BASELINE}$) associated with a linear baseline first relationship.

Example 20 may include elements of any of examples 17 through 19 where the instructions that cause the display power management control circuitry to determine the one or more image quality (IQ) parameters for the baseline display power mode ($IQ_{BASELINE}$) using a first parameter ($K_{1,BASELINE}$) associated with a linear baseline first relationship age further cause the display power management control circuitry to: determine the one or more image quality (IQ) parameters for a baseline display power mode ($IQ_{BASELINE}$) using a slope ($K_{1,BASELINE}$) associated with a linear baseline first relationship.

Example 21 may include elements of any of examples 17 through 20 where the instructions that cause the display power management control circuitry to determine the one or more image quality (IQ) parameters for the baseline display power mode ($IQ_{BASELINE}$) using: the baseline first parameter ($K_{1,BASELINE}$) associated with the baseline first relationship; the baseline percentage of the plurality of pixels ($X_{i,BASELINE}$) having the defined color value; and the baseline second parameter ($K_{0,BASELINE}$) associated with the baseline second relationship further cause the display power management control circuitry to: determine the one or more image quality (IQ) parameters for a baseline display power mode ($IQ_{BASELINE}$) using a second parameter ($K_{0,BASELINE}$) associated with a linear baseline second relationship.

Example 22 may include elements of any of examples 17 through 21 where the instructions that cause the display power management control circuitry to determine the one or more image quality (IQ) parameters for a baseline display power mode ($IQ_{BASELINE}$) using a second parameter ($K_{0,BASELINE}$) associated with a linear baseline second relationship further cause the display power management control circuitry to: determine the one or more image quality (IQ) parameters for a baseline display power mode ($IQ_{BASELINE}$) using a slope ($K_{0,BASELINE}$) associated with a linear baseline second relationship.

Example 23 may include elements of any of examples 17 through 22 where the instructions that cause the display power management control circuitry to determine the one or more image quality (IQ) parameters for a baseline display power mode ($IQ_{BASELINE}$) further cause the display power management control circuitry to: determine the one or more image quality (IQ) parameters for a baseline display power mode ($IQ_{BASELINE}$) on a per-pixel basis.

Example 24 may include elements of any of examples 17 through 23 where the instructions that cause the display power management control circuitry to determine the one or more image quality (IQ) parameters for a baseline display power mode ($IQ_{BASELINE}$) on a per-pixel basis further cause the display power management control circuitry to: determine the one or more IQ parameters ($IQ_{n,m}$) representative of the display image provided by the selected first parameter and the selected second parameter pair ($K_{1,m}$, $K_{0,n}$) on a per-pixel basis.

According to example 25, there is provided a display power reduction system. The system may include: means for determining one or more image quality (IQ) parameters for a baseline display power mode ($IQ_{BASELINE}$) using: a baseline first parameter ($K_{1,BASELINE}$) associated with a baseline first relationship between a baseline number of original pixel values and a baseline number of boosted pixel values used to form the display image; a baseline percentage of the plurality of pixels ($X_{i,BASELINE}$) having a defined color value; a baseline second parameter ($K_{0,BASELINE}$) associated with a baseline second relationship between the baseline number of original pixel values and a baseline number of boosted pixel values; means for adjusting the second parameter to each of a plurality of second parameter values ($K_{0,1-n}$) and, for each of the plurality of second parameter values ($K_{0,n}$): means for adjusting the percentage of pixels having the defined color value to a plurality of pixel percentages ($X_{i,1-m}$); means for determining the value of the first parameter at each of the plurality of pixel percentages using the second parameter value ($K_{0,n}$) and the respective pixel percentage value ($X_{i,m}$); and means for determining the one or more image quality parameters ($IQ_{n,m}$); and means for selecting a first parameter, second parameter pair ($K_{0,n}$, $K_{1,m}$) associated with the one or more IQ parameters ($IQ_{m,n}$) closest to the one or more baseline IQ parameters ($IQ_{BASELINE}$).

Example 26 may include elements of example 25, and the system may further include: means for receiving data representative of a baseline display power mode that includes: data indicative of a value representative of the percentage of pixels having the defined color value ($X_{i,BASELINE}$); wherein the baseline first relationship ($K_{1,BASELINE}$) shares a common value with the baseline second relationship ($K_{0,BASELINE}$) at the value representative of the percentage of pixels having the defined color value ($X_{i,BASELINE}$).

Example 27 may include elements of any of examples 25 or 26 where the means for determining one or more image quality (IQ) parameters for the baseline display power mode ($IQ_{BASELINE}$) using: the baseline first parameter ($K_{1,BASELINE}$) associated with the baseline first relationship; the baseline percentage of the plurality of pixels ($X_{i,BASELINE}$) having the defined color value; and the baseline second parameter ($K_{0,BASELINE}$) associated with the baseline second relationship further comprises: means for determining the one or more image quality (IQ) parameters for the baseline display power mode ($IQ_{BASELINE}$) using a first parameter ($K_{1,BASELINE}$) associated with a linear baseline first relationship.

Example 28 may include elements of any of examples 25 through 27 where the means for determining the one or more image quality (IQ) parameters for the baseline display power mode (IQBASELINE) using the first parameter (K1,BASELINE) associated with the linear baseline first relationship further comprises: means for determining the one or more image quality (IQ) parameters for a baseline display power mode ($IQ_{BASELINE}$) using a slope ($K_{1,BASELINE}$) associated with a linear baseline first relationship.

Example 29 may include elements of any of examples 25 through 28 where the means for determining one or more image quality (IQ) parameters for the baseline display power mode ($IQ_{BASELINE}$) using: the baseline first parameter ($K_{1,BASELINE}$) associated with the baseline first relationship; the baseline percentage of the plurality of pixels ($X_{i,BASELINE}$) having the defined color value; and the baseline second parameter ($K_{0,BASELINE}$) associated with the baseline second relationship further comprises: means for determining the one or more image quality (IQ) parameters for a baseline display power mode ($IQ_{BASELINE}$) using a second parameter ($K_{0,BASELINE}$) associated with a linear baseline second relationship.

Example 30 may include elements of any of examples 25 through 29 where the means for determining the one or more image quality (IQ) parameters for a baseline display power mode ($IQ_{BASELINE}$) using a second parameter ($K_{0,BASELINE}$) associated with a linear baseline second relationship further comprises: means for determining the one or more image quality (IQ) parameters for a baseline display power mode ($IQ_{BASELINE}$) using a slope ($K_{0,BASELINE}$) associated with a linear baseline second relationship.

Example 31 may include elements of any of examples 25 through 30 where the means for determining the one or more image quality (IQ) parameters for a baseline display power mode ($IQ_{BASELINE}$) further comprises: means for determining the one or more image quality (IQ) parameters for a baseline display power mode ($IQ_{BASELINE}$) on a per-pixel basis.

Example 32 may include elements of any of examples 25 through 31 where the means for determining the one or more image quality (IQ) parameters for a baseline display power mode ($IQ_{BASELINE}$) on a per-pixel basis further comprises: means for determining the one or more IQ parameters ($IQ_{n,m}$) representative of the display image provided by the selected first parameter and the selected second parameter pair ($K_{1,m}$, $K_{0,n}$) on a per-pixel basis.

The terms and expressions which have been employed herein are used as terms of description and not of limitation, and there is no intention, in the use of such terms and expressions, of excluding any equivalents of the features shown and described for portions thereof), and it is recognized that various modifications are possible within the scope of the claims. Accordingly, the claims are intended to cover all such equivalents. Various features, aspects, and embodiments have been described herein. The features, aspects, and embodiments are susceptible to combination with one another as well as to variation and modification, as will be understood by those having skill in the art. The present disclosure should, therefore, be considered to encompass such combinations variations, and modifications.

As described herein, various embodiments may be implemented using hardware elements, software elements, or any combination thereof. Examples of hardware elements may include processors, microprocessors, circuits, circuit elements (e.g., transistors, resistors, capacitors, inductors, and so forth), integrated circuits, application specific integrated circuits (ARC), programmable logic devices (PLD), digital signal processors (DSP), field programmable gate array (FPGA), logic gates, registers, semiconductor device, chips, microchips, chip sets, and so forth.

Reference throughout this specification to "one embodiment" or "an embodiment" means that a particular feature, structure, or characteristic described in connection with the embodiment is included in at least one embodiment. Thus, appearances of the phrases "in one embodiment" or "in an embodiment" in various places throughout this specification are not necessarily all referring to the same embodiment. Furthermore the particular features, structures, or characteristics may be combined in any suitable manner in one or more embodiments.

What is claimed:

1. A display power reduction system, comprising:

display interface circuitry to access data corresponding to an image on a display device;

display power management control circuitry in circuit with the display interface circuitry, the display power management control circuitry to:

determine a baseline image quality parameter ($IQ_{BASELINE}$) associated with a baseline display power mode based on:

a baseline first relationship parameter ($K_{1,BASELINE}$) associated with a first relationship between a number of original pixel values and a number of boosted pixel values corresponding to the image;

a baseline percentage of pixels ($X_{i,BASELINE}$) having a color value in the baseline display power mode; and a baseline second relationship parameter ($K_{0,BASELINE}$) associated with a second relationship between the number of original pixel values and the number of boosted pixel values corresponding to the image;

determine a value of a subsequent first relationship parameter ($K_{1,n,m}$) based on an adjusted second relationship parameter ($K_{0,n}$) and a second percentage of pixels ($X_{i,m}$) having the color value;

determine a second image quality parameter ($IQ_{n,m}$) associated with the subsequent first relationship parameter ($K_{1,n,m}$), the adjusted second relationship parameter ($K_{0,n}$), and the second percentage of pixels ($X_{i,m}$); and select the subsequent first relationship parameter ($K_{1,n,m}$) and the adjusted second relationship parameter ($K_{0,n}$) based on a comparison of the second image quality parameter ($IQ_{n,m}$) to the baseline image quality parameter ($IQ_{BASELINE}$).

2. The system of claim 1, wherein the baseline first relationship parameter ($K_{1,BASELINE}$) intersects with the baseline second relationship parameter ($K_{0,BASELINE}$) at the baseline percentage of pixels ($X_{i,BASELINE}$) having the color value.

3. The system of claim 2, wherein the display power management control circuitry is to:

determine the baseline image quality parameter ($IQ_{BASELINE}$) for the baseline display power mode based on the baseline first relationship parameter ($K_{1,BASELINE}$) associated with a linear first relationship.

4. The system of claim 3, wherein the display power management control circuitry is to:

determine the baseline image quality parameter ($IQ_{BASELINE}$) for the baseline display power mode based on the baseline first relationship parameter ($K_{1,BASELINE}$) representative of a first slope of the linear first relationship.

5. The system of claim 4, wherein the display power management control circuitry is to:

determine the baseline image quality parameter ($IQ_{BASELINE}$) for the baseline display power mode based on the baseline second relationship parameter ($K_{0,BASELINE}$) associated with a linear second relationship.

6. The system of claim 5, wherein the display power management control circuitry is to:

determine the baseline image quality parameter ($IQ_{BASELINE}$) for the baseline display power mode based on the baseline second relationship parameter ($K_{0,BASELINE}$) representative of a second slope of the linear second relationship.

7. The system of claim 1, wherein the display power management control circuitry is to:

determine the baseline image quality parameter ($IQ_{BASELINE}$) for the baseline display power mode on a per-pixel basis.

8. The system of claim 7, wherein the display power management control circuitry is to:

determine the second image quality parameter ($IQ_{n,m}$) associated with the subsequent first relationship parameter ($K_{1,n,m}$), the adjusted second relationship parameter ($K_{0,n}$), and the second percentage of pixels ($X_{i,m}$) on a per-pixel basis.

9. A non-transitory storage device comprising instructions that, when executed, cause circuitry to at least:

determine a baseline image quality parameter ($IQ_{BASELINE}$) for a baseline display power mode based on:

a baseline first relationship parameter ($K_{1,BASELINE}$) associated with a first relationship between a number of original pixel values and a number of boosted pixel values corresponding to an image;

a baseline percentage of pixels ($X_{i,BASELINE}$) having a color value in the baseline display power mode; and a baseline second relationship parameter ($K_{0,BASELINE}$) associated with a second relationship between the number of original pixel values and the number of boosted pixel values corresponding to the image;

determine a value of a subsequent first relationship parameter ($K_{1,n,m}$) based on an adjusted second relationship parameter ($K_{0,n}$) and a second percentage of pixels ($X_{i,m}$) having the color value;

determine a second image quality parameter ($IQ_{n,m}$) associated with the subsequent first relationship parameter ($K_{1,n,m}$), the adjusted second relationship parameter ($K_{0,n}$), and the second percentage of pixels ($X_{i,m}$); and select the subsequent first relationship parameter ($K_{1,n,m}$) and the adjusted second relationship parameter ($K_{0,n}$) based on a comparison of the second image quality parameter ($IQ_{n,m}$) to the baseline image quality parameter ($IQ_{BASELINE}$).

10. The non-transitory storage device of claim 9, wherein the instructions are to cause the circuitry to establish an intersection between the baseline first relationship parameter ($K_{1,BASELINE}$) and the baseline second relationship parameter ($K_{0,BASELINE}$) at the baseline percentage of pixels ($X_{i,BASELINE}$) having the color value.

11. The non-transitory storage device of claim 10, wherein the instructions are to cause the circuitry to:

determine the baseline image quality parameter ($IQ_{BASELINE}$) for the baseline display power mode based on the baseline first relationship parameter ($K_{1,BASELINE}$) associated with a linear first relationship.

12. The non-transitory storage device of claim 11 wherein the instructions are to cause the circuitry to:

determine the baseline image quality parameter ($IQ_{BASELINE}$) for the baseline display power mode based on the baseline first relationship parameter ($K_{1,BASELINE}$) representative of a first slope of the linear first relationship.

13. The non-transitory storage device of claim 12, wherein the instructions are to cause the circuitry to:

determine the baseline image quality parameter ($IQ_{BASELINE}$) for the baseline display power mode based on the baseline second relationship parameter ($K_{0,BASELINE}$) associated with a linear second relationship.

14. The non-transitory storage device of claim 13 wherein the instructions are to cause the circuitry to:

determine the baseline image quality parameter ($IQ_{BASELINE}$) for the baseline display power mode based on the baseline second relationship parameter ($K_{0,BASELINE}$) representative of a second slope of the linear second relationship.

15. The non-transitory storage device of claim 9, wherein the instructions are to cause the circuitry to:

determine the baseline image quality parameter ($IQ_{BASELINE}$) for the baseline display power mode on a per-pixel basis.

16. The non-transitory storage device of claim 15, wherein the instructions are to cause the circuitry to:

determine the second image quality parameter ($IQ_{n,m}$) associated with the subsequent first relationship parameter ($K_{1,n,m}$), the adjusted second relationship parameter ($K_{0,n}$), and the second percentage of pixels ($X_{i,m}$) on a per-pixel basis.

17. A display power reduction system, comprising:

means for storing; and means for determining a baseline image quality parameter ($IQ_{BASELINE}$) for a baseline display power mode based on:

a baseline first relationship parameter ($K_{1,BASELINE}$) associated with a first relationship between a number of original pixel values and a number of boosted pixel values corresponding to an image;

a baseline percentage of pixels ($X_{i,BASELINE}$) having a color value in the baseline display power mode; and a baseline second relationship parameter ($K_{0,BASELINE}$) associated with a second relationship between the number of original pixel values and the number of boosted pixel values corresponding to the image;

the determining means to determine an adjusted second relationship parameter ($K_{0,n}$) relative to the baseline second relationship parameter ($K_{0,BASELINE}$) and, for the adjusted second relationship parameter ($K_{0,n}$):

determine a second percentage of pixels ($X_{i,m}$) having the color value;

determine a value of a subsequent first relationship parameter ($K_{1,n,m}$) based on the adjusted second relationship parameter ($K_{0,n}$) and the second percentage of pixels ($X_{i,m}$); and determine a second image quality parameter ($IQ_{n,m}$) associated with the subsequent first relationship parameter ($K_{1,n,m}$), the adjusted second relationship parameter ($K_{0,n}$), and the second percentage of pixels ($X_{i,m}$); and the determining means to select the subsequent first relationship parameter ($K_{1,n,m}$) and the adjusted second relationship parameter ($K_{0,n}$) based on a comparison of the second image quality parameter ($IQ_{n,m}$) to the baseline image quality parameter ($IQ_{BASELINE}$).

18. The system of claim 17, wherein the baseline first relationship parameter ($K_{1,BASELINE}$) intersects with the baseline second relationship parameter ($K_{0,BASELINE}$) at the baseline percentage of pixels ($X_{i,BASELINE}$) having the color value.

19. The system of claim 18, wherein the determining means is to:

determine the baseline image quality parameter ($IQ_{BASELINE}$) for the baseline display power mode based on the baseline first relationship parameter ($K_{1,BASELINE}$) associated with a linear first relationship.

20. The system of claim 19, wherein the determining means is to:

determine the baseline image quality parameter ($IQ_{BASELINE}$) for the baseline display power mode based on the baseline first relationship parameter ($K_{1,BASELINE}$) representative of a first slope of the linear first relationship.

21. The system of claim 20, wherein the determining means is to:

determine the baseline image quality parameter ($IQ_{BASELINE}$) for the baseline display power mode based on the baseline second relationship parameter ($K_{0,BASELINE}$) associated with a linear second relationship.

22. The system of claim 21, wherein the determining means is to:

determine the baseline image quality parameter ($IQ_{BASELINE}$) for the baseline display power mode based on the baseline second relationship parameter ($K_{0,BASELINE}$) representative of a second slope of the linear second relationship.

23. The system of claim 17, wherein the determining means is to:

determine the baseline image quality parameter ($IQ_{BASELINE}$) for the baseline display power mode on a per-pixel basis.

24. The system of claim 23, wherein the determining means is to:

determine the second image quality parameter ($IQ_{n,m}$) associated with the subsequent first relationship parameter ($K_{1,n,m}$), the adjusted second relationship parameter ($K_{0,n}$), and the second percentage of pixels ($X_{i,m}$) on a per-pixel basis.

* * * * *